US009141076B2

(12) United States Patent
Yuzawa

(10) Patent No.: US 9,141,076 B2
(45) Date of Patent: Sep. 22, 2015

(54) IMAGE FORMING APPARATUS HAVING A CARTRIDGE HOLDING MEMBER LOCK

(71) Applicant: CANON KABUSHIKI KAISHA, Tokyo (JP)

(72) Inventor: Atsuyuki Yuzawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/074,801

(22) Filed: Nov. 8, 2013

(65) Prior Publication Data

US 2014/0140724 A1 May 22, 2014

(30) Foreign Application Priority Data

Nov. 20, 2012 (JP) ..... 2012-254294

(51) Int. Cl.
*G03G 21/16* (2006.01)

(52) U.S. Cl.
CPC .... *G03G 21/1633* (2013.01); *G03G 2215/0132* (2013.01); *G03G 2221/1684* (2013.01)

(58) Field of Classification Search
CPC ..... G03G 21/1633
USPC ..... 399/110, 125
See application file for complete search history.

(56) References Cited

U.S. PATENT DOCUMENTS 5,978,626 A * 11/1999 Nagamine et al. ..... 399/125
7,715,753 B2 5/2010 Hisada
7,894,747 B2 2/2011 Hisada
8,126,356 B2 * 2/2012 Watanabe et al. ..... 399/110
8,150,294 B2 * 4/2012 Okabe et al. ..... 399/110 X
8,265,520 B2 * 9/2012 Irie et al. ..... 399/110
2008/0304860 A1 12/2008 Hisada
2010/0183352 A1 7/2010 Hisada
2011/0299883 A1 12/2011 Suzuki
2012/0207511 A1 * 8/2012 Sato ..... 399/110

FOREIGN PATENT DOCUMENTS

JP 2006-098772 A 4/2006
JP 2008-275805 A 11/2008
JP 2011-253049 A 12/2011
JP 2012-058287 A 3/2012

* cited by examiner

*Primary Examiner* — Sandra Brase
(74) *Attorney, Agent, or Firm* — Fitzpatrick, Cella, Harper & Scinto

(57) ABSTRACT

An image forming apparatus includes an exposure device exposing a photosensitive member, an exposure device support member supporting the exposure device, a cartridge holding member holding a cartridge which includes the photosensitive member, and a locking mechanism to prevent the cartridge holding member from being drawn out from the main body of the apparatus. The locking mechanism includes a locking member that is movable between a locking position at which the locking member is engaged with the cartridge holding member and an unlocking position at which the locking member is disengaged from the cartridge holding member, and an interlocking mechanism having an urging member urging the locking member so it is located at the locking position, and a pressing member that is displaced along with the movement of the exposure device support member and presses the locking member against an urging force of the urging member so as to move the locking member to the unlocking position.

21 Claims, 24 Drawing Sheets

IMAGE FORMING APPARATUS HAVING A CARTRIDGE HOLDING MEMBER LOCK

BACKGROUND OF THE INVENTION

1. Field of the Invention

The present invention relates to an image forming apparatus such as a copying machine and a printer, which has a function to form an image on a recording material such as a sheet.

2. Description of the Related Art

As disclosed in Japanese Patent Application Laid-Open No. 2006-98772, in general, in an image forming apparatus such as an LED type printer and an LED type copying machine, an LED light beam corresponding to image data generated based on a print object is radiated to a photosensitive member so as to form an electrostatic latent image on the photosensitive member. Toner is supplied from a cartridge (process cartridge) to the electrostatic latent image on the photosensitive member so as to form a toner image on the photosensitive member. The toner image is transferred onto a recording material, and then fixed thereto. In this way, an image is formed on the recording material.

In this image forming apparatus, an LED unit for radiating the LED light beam needs to be arranged near the photosensitive member so as to face the photosensitive member. Thus, in an LED type monochromatic/color image forming apparatus, LED units corresponding to respective colors are set between the cartridges.

Therefore, in this apparatus, the cartridges cannot be replaced by being forward drawn out from the apparatus.

Japanese Patent Application Laid-Open No. 2008-275805 discloses a structure in which the LED units are retracted above the cartridges along with an opening operation of an upper door so that the cartridges are forward drawn out from a main body of the image forming apparatus.

However, in the structure of Japanese Patent Application Laid-Open No. 2008-275805, the upper door (support member) on which the LED units (exposure devices) are mounted may be closed even when the cartridges and a receiving tray for holding the cartridges in a removable manner are being moved in front and rear directions of the main body of the image forming apparatus.

Therefore, in this structure, the upper door may be closed even under a state in which the cartridges are out of image forming positions, and hence the LED units may be damaged.

SUMMARY OF THE INVENTION

According to the present invention, an exposure device can be prevented from damaging due to movement of a support member in a structure in which the support member for supporting the exposure device is moved to space the exposure device apart from an image bearing member and, in this state, a member for holding cartridges in a removable manner is drawn out to replace the cartridges.

Further, the present invention provides an image forming apparatus that exposes a photosensitive member so as to form a latent image, and transfers a toner image obtained through development of the latent image to form an image on a recording material, the image forming apparatus including: an exposure device exposing the photosensitive member; a cartridge holding member holding a cartridge which includes the photosensitive member, the cartridge holding member being allowed to be drawn out from a main body of the apparatus by moving the exposure device to a retracted position, at which the exposure device is retracted from the cartridge; and a first locking mechanism locking the cartridge holding member so as to prevent the cartridge holding member from being drawn out from the main body of the apparatus until the exposure device is retracted to the retracted position.

Further, the present invention provides an image forming apparatus that exposes a photosensitive member so as to form a latent image, and transfers a toner image obtained through development of the latent image to form an image on a recording material, the image forming apparatus including: an exposure device exposing the photosensitive member; a cartridge holding member holding a cartridge including the photosensitive member, the cartridge holding member being allowed to be drawn out from a main body of the apparatus by moving the exposure device to a retracted position, at which the exposure device is retracted from the cartridge; and a locking mechanism keeping the exposure device from being moved from the retracted position under a state in which the cartridge holding member is drawn out from the main body of the apparatus.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Now, exemplary embodiments of the present invention are described in detail with reference to the drawings. Note that, dimensions, materials, shapes, relative arrangements, and the like of components described in those embodiments may be appropriately changed in accordance with a structure and other various conditions of an apparatus to which the present invention is applied. Thus, those factors are not intended to limit the scope of the present invention to the following embodiments.

A cartridge (process cartridge) is a unit that is obtained by integrating a charging unit, a developing unit, or a cleaning unit, which serves as a process unit for an image bearing member, and the image bearing member with each other into a cartridge and that is removable with respect to a main body of an image forming apparatus. Alternatively, the cartridge is a unit that is obtained by integrating at least one of the charging unit, the developing unit, and the cleaning unit, which serve as the process units, and the image bearing member with each other into a cartridge and that is removable with respect to the main body of the image forming apparatus. Still alternatively, the cartridge is a unit that is obtained by integrating at least the developing unit, which serves as the process unit, and the image bearing member with each other into a cartridge and that is removable with respect to the main body of the image forming apparatus.

First Embodiment

Now, a first embodiment of the present invention is described.

Figure 1:
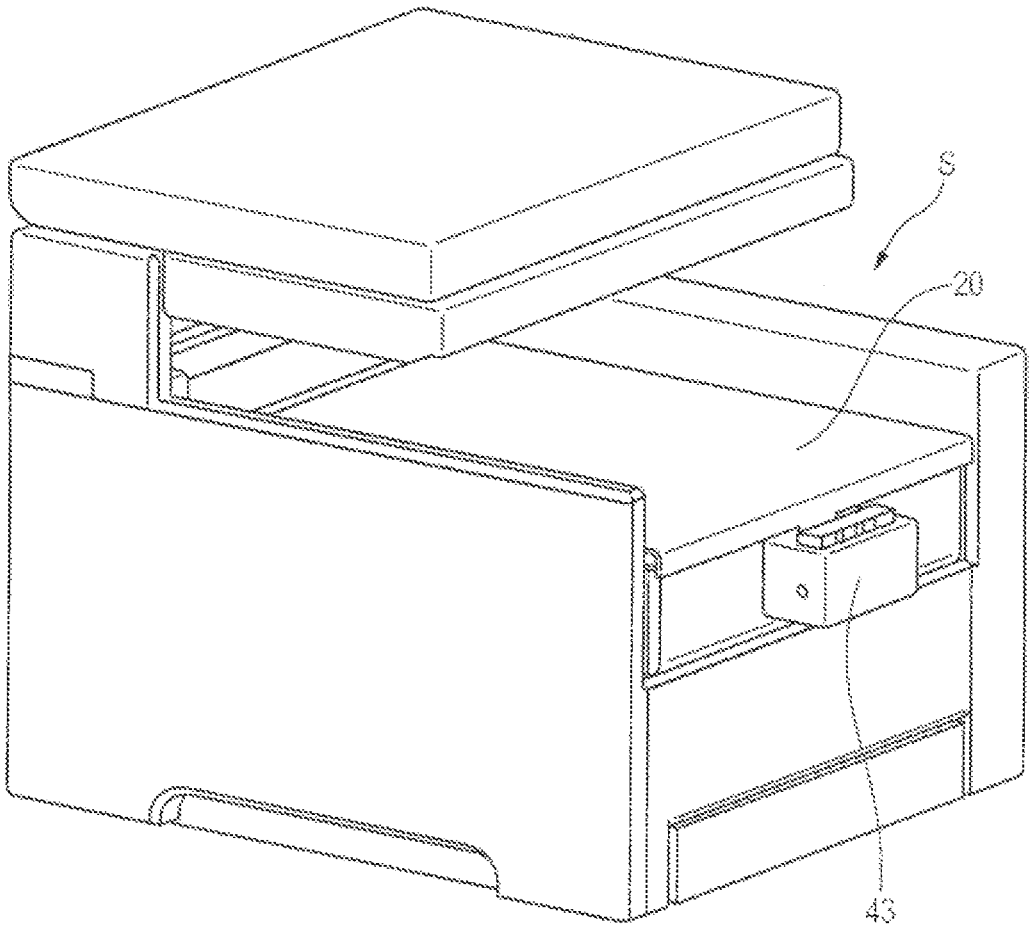
FIG. 1 is a schematic perspective view of an image forming apparatus according to a first embodiment of the present invention.
Figure 2:
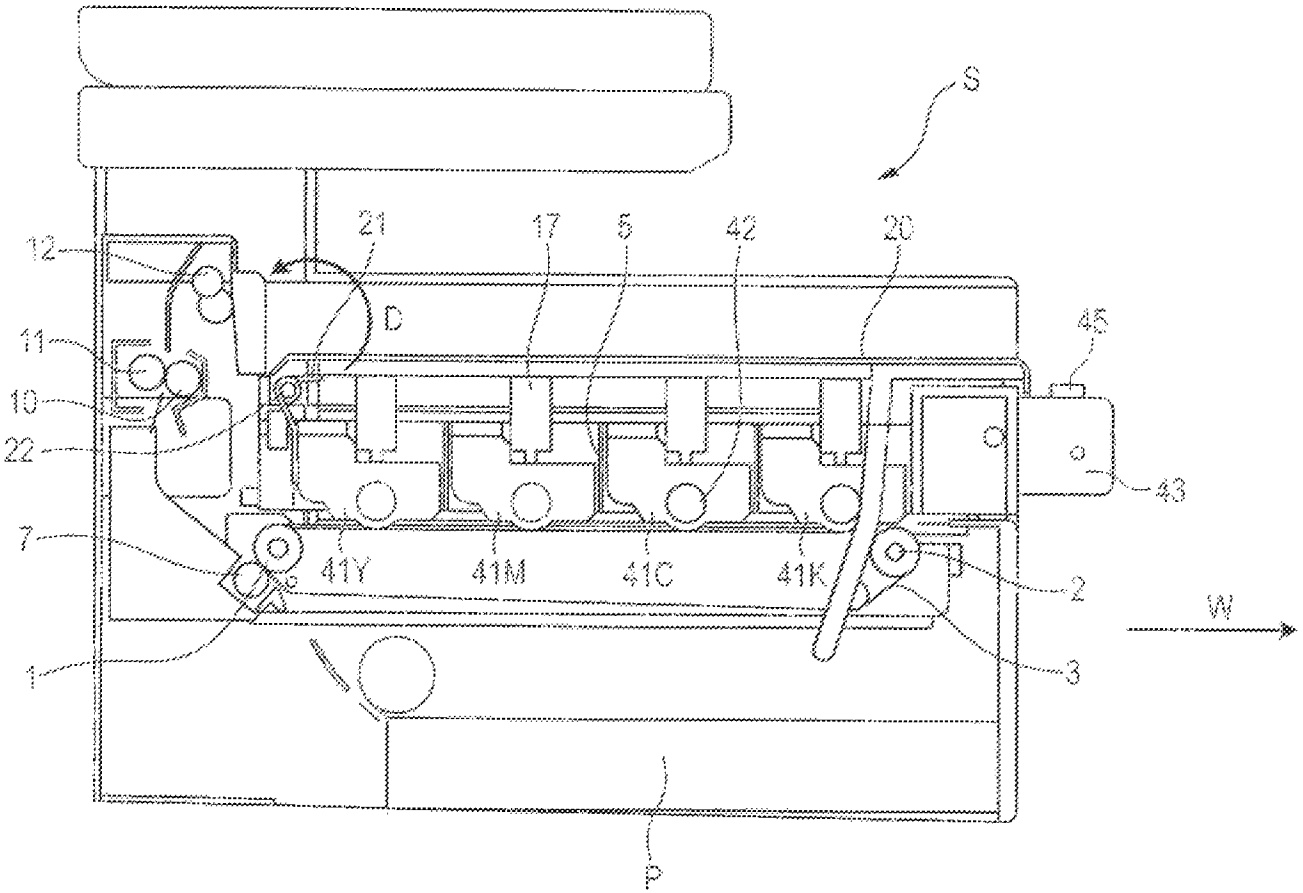
FIG. 2 is a sectional view of a schematic structure of the image forming apparatus according to the first embodiment.

FIG. 1 is a schematic perspective view of an image forming apparatus according to this embodiment. FIG. 2 is a sectional view of a schematic structure of the image forming apparatus according to this embodiment.

An image forming apparatus S includes a plurality of cartridges 41 arrayed along a peripheral surface of an intermediate transfer belt 3 stretched around a drive roller 1 and a tension roller 2. In a receiving tray 43 that serves as a cartridge holding member, the cartridges 41 are arranged in a single horizontal array in an order of yellow (Y), magenta (M), cyan (C), and black (K) from a depth side toward a front side of the image forming apparatus S (in a direction of an arrow W illustrated in FIG. 2).

The cartridges 41 each include a photosensitive drum 42 that serves as a rotatable photosensitive member (image bearing member), and a developing roller (developing unit) for developing a latent image (electrostatic latent image) formed on a surface of the photosensitive drum 42 into a toner image. The image forming apparatus S includes a plurality of LED units 17 that are arrayed, similarly to the cartridges 41, in the direction of the arrow W illustrated in FIG. 2, and each serve as an exposure device for exposing the photosensitive drum 42 so as to form the latent image (electrostatic latent image) on the surface of the photosensitive drum 42 (image bearing member). The LED units 17 each include a plurality of light emitting elements that are arrayed in a direction of a rotation axis of the photosensitive drum 42 and emit light in accordance with image information.

Structures and operations of the cartridges 41, the LED units 17, and transfer devices (transfer units) are substantially the same as each other except for the difference in the respective colors of toner to be used. Thus, unless it is necessary to make specific distinctions in the following description, suffixes Y, M, C, and K for indicating the corresponding colors are omitted from reference symbols of components, and those components are generally described.

The receiving tray 43 includes a plurality of cartridge mounting portions 5 for respectively receiving (accommodating or holding) the cartridges 41 in a removable manner. The cartridge mounting portions 5 are each opened in a vertical direction so that the cartridges 41 can be removable from its inside (received therein). In the description of this embodiment, the direction of the arrow W illustrated in FIG. 2 corresponds to a front direction of the image forming apparatus S, and a direction opposite to the direction of the arrow W corresponds to a rear direction of the image forming apparatus S. The vertical direction corresponds to upper and lower directions in a vertical direction under an installation state (use state) of the image forming apparatus S.

The receiving tray 43 is mounted to be slidable with respect to a main body of the image forming apparatus S in the direction of the arrow W illustrated in FIG. 2. Above the receiving tray 43, an upper door 20 that serves as an exposure device support member is provided to be rotatable with respect to the main body of the image forming apparatus S. The LED units 17 are arranged (supported) on the upper door 20.

In the image forming apparatus S according to this embodiment, the upper door 20 is turned and moved upward with respect to the receiving tray 43 so as to space the LED units 17 apart from the photosensitive drums 42. In this state, the receiving tray 43 can be drawn out from the main body of the image forming apparatus S. The cartridges 41 are mounted to be removable with respect to the receiving tray 43 so that a replacement operation can be performed under the state in which the receiving tray 43 is drawn out from the main body of the image forming apparatus S (refer to FIG. 10). A direction in which the receiving tray 43 is drawn out from the main body of the image forming apparatus S is the same as a direction in which the plurality of cartridges 41 are arrayed (direction of the arrow W illustrated in FIG. 2).

An image forming operation in the image forming apparatus S is described.

First, each LED unit 17 at an exposure position exposes the photosensitive drum 42 so as to form a latent image on the surface of the photosensitive drum 42. Then, the developing roller develops the latent image formed on the surface of the photosensitive drum 42. In this way, toner images of the corresponding colors are formed on the surfaces of the photosensitive drums 42.

The toner images of the corresponding colors, which are formed on the photosensitive drums 42, are primarily transferred in a sequential manner onto the intermediate transfer belt 3 at primary transfer portions (nip portions) formed between the photosensitive drums 42 and the intermediate transfer belt 3.

Subsequently, the toner images transferred on the intermediate transfer belt 3 are secondarily transferred onto a recording material P at a secondary transfer portion (nip portion) formed between the intermediate transfer belt 3 and a transfer roller 7. In this way, the toner images are formed on the recording material P. The recording material P on which the toner images are formed is nipped in a fixing nip portion formed between a fixing rotating member 10 and a pressure roller 11, and heated and pressurized during conveyance. In this way, the toner images on the recording material P are fixed to the recording material P. The recording material P to which the toner images are fixed in the fixing nip portion is guided by a delivery portion 12 to an outside of the main body of the image forming apparatus S, and lastly accumulated on the upper door 20.

(Unlocking Mechanism for Unlocking Upper Door and Receiving Tray in Conjunction with Handle)

Figure 3:
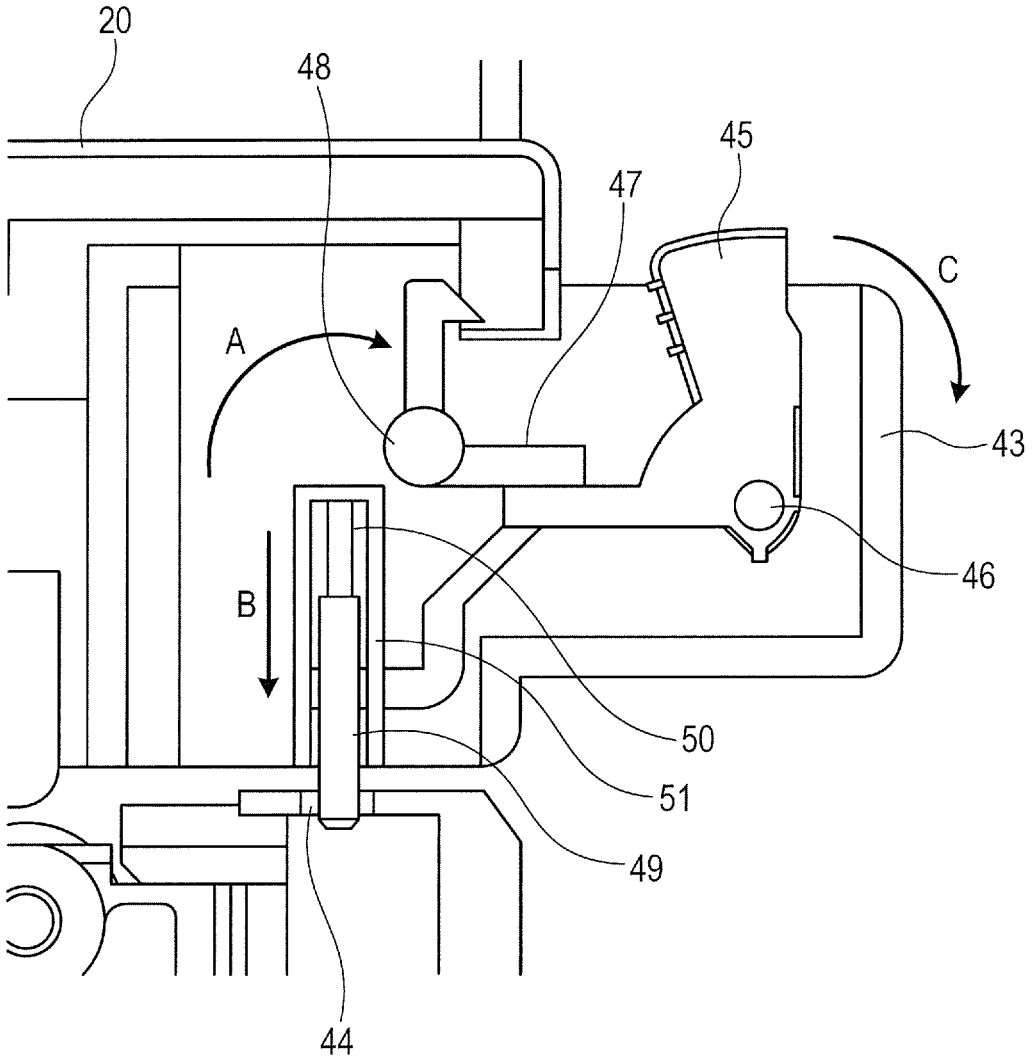
FIG. 3 is a schematic structural view of an unlocking mechanism for an upper door and a receiving tray according to the first embodiment.
Figure 4:
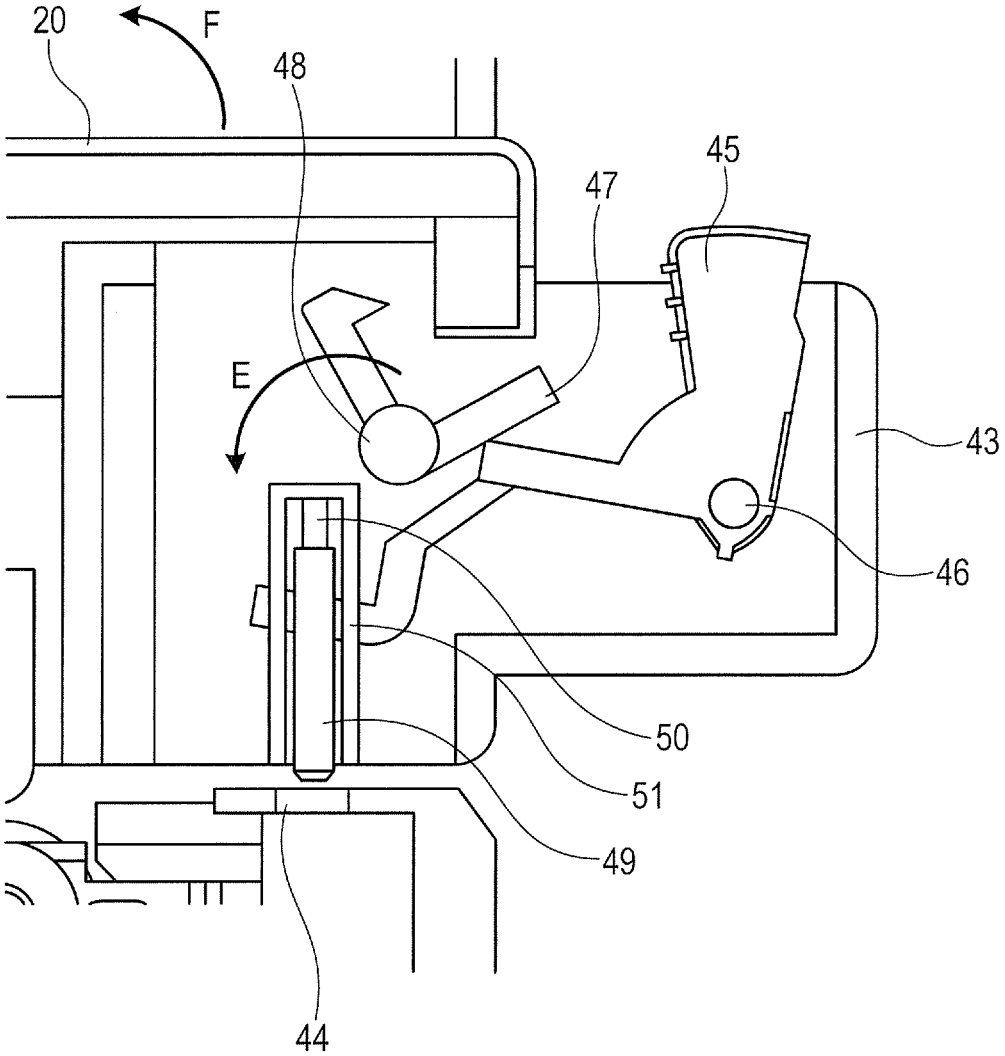
FIG. 4 is a schematic structural view of the unlocking mechanism for the upper door and the receiving tray according to the first embodiment.

FIGS. 3 and 4 are each a sectional view of a schematic structure of a locking mechanism for the upper door 20 and the receiving tray 43. FIG. 3 illustrates a state in which the upper door 20 and the receiving tray 43 are locked, and FIG. 4 illustrates a state in which the upper door 20 and the receiving tray 43 are unlocked.

As illustrated in FIGS. 3 and 4, a handle 45 that is operated when forward drawing out the receiving tray 43 from the main body of the image forming apparatus S is supported by the receiving tray 43 so as to be rotatable about a handle rotation center 46. The handle 45 corresponds to an operation member.

An upper door lock 47 for locking the upper door in a closed state is similarly supported by the receiving tray 43 so as to be rotatable about an upper door lock rotation center 48. The upper door lock 47 is constantly urged by an urging spring (not shown) in a direction of an arrow A illustrated in FIG. 3. The upper door lock 47 and an engagement portion of the upper door 20, with which the upper door lock 47 engages when locking the upper door 20, serve as a third locking mechanism.

The receiving tray 43 includes a front tray lock 49 for locking the receiving tray 43 to the main body of the image forming apparatus S in the front of the receiving tray 43, and a rail portion 51 for guiding the front tray lock 49 in a slidable manner.

The front tray lock 49 is mounted to the receiving tray 43 under a state in which the front tray lock 49 is urged by a front tray lock spring 50 in a direction of an arrow B illustrated in FIG. 3 with respect to the receiving tray 43.

The front tray lock 49 is engaged with a front tray lock hole 44 formed through a casing (frame) of the main body of the image forming apparatus S. With this, a front side of the receiving tray 43 is locked (engaged or latched) with respect to the main body of the image forming apparatus S.

When the front tray lock 49 and the front tray lock hole 44 are disengaged from each other, the receiving tray 43 is unlocked from the main body of the image forming apparatus S.

Next, with reference to FIGS. 2 to 4, how the upper door lock 47 is released in conjunction with the handle 45 is described.

The upper door 20 is mounted to the main body of the image forming apparatus S so as to be rotatable (openable and closable) about an upper door rotation center 22 illustrated in FIG. 2. The upper door 20 is urged by an urging spring 21 that serves as a second urging member in a direction of an arrow D illustrated in FIG. 2 with respect to the main body of the image forming apparatus S. The urging spring 21 and the third locking mechanism serve as a second interlocking mechanism for starting movement of the upper door 20 in conjunction with an operation to the handle 45.

In a state illustrated in FIG. 3, the handle 45 has not yet been pulled (operated) in a direction of an arrow C. Thus, in order that the upper door 20 is not turned by the urging spring 21 in the direction of the arrow D illustrated in FIG. 2, the upper door 20 is locked by the upper door lock 47 against an urging force of the urging spring 21.

When a user operates and turns the handle 45 in the direction of the arrow C illustrated in FIG. 3, the upper door lock 47 engaged with the handle 45 is turned in a direction of an arrow E as illustrated in FIG. 4. With this, the upper door 20 is unlocked from the upper door lock 47, and the upper door 20 starts to be turned by the urging force of the urging spring 21 in a direction of an arrow F illustrated in FIG. 4.

Simultaneously, the front tray lock 49 engaged with the handle 45 is also slid in a direction opposite to the direction of the arrow B illustrated in FIG. 3 in conjunction with movement of the handle 45. As a result, the front tray lock 49 is disengaged from the front tray lock hole 44.

Figure 5:
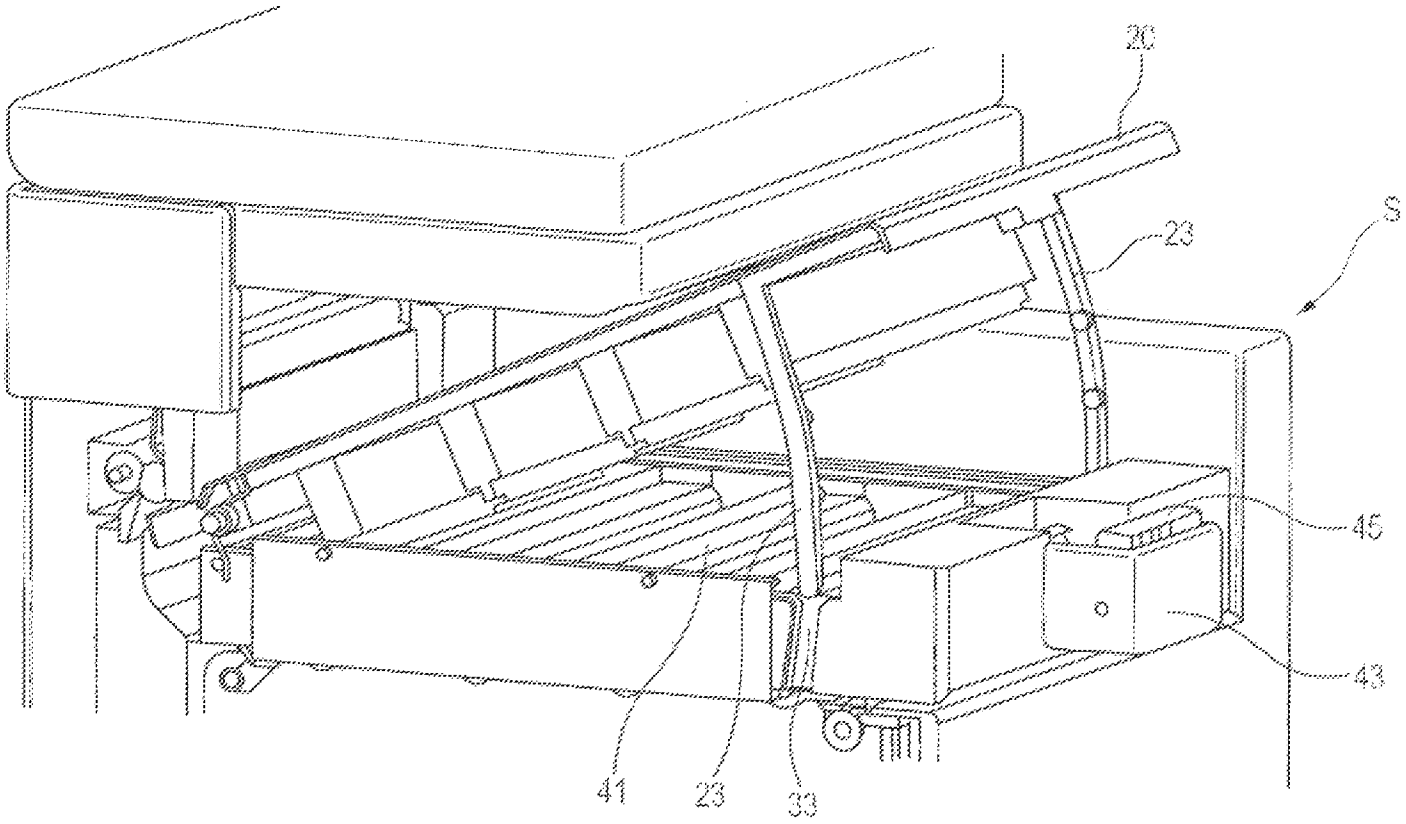
FIG. 5 illustrates a state in which the upper door according to the first embodiment is fully opened.

In this way, the upper door 20 is fully opened with respect to the main body of the image forming apparatus S, and the receiving tray 43 locked by the front tray lock 49 with respect to the main body of the image forming apparatus S is unlocked. Simultaneously, the LED units 17 each move from the exposure position to a predetermined retracted position so as to be retracted from the cartridge 41. FIG. 5 illustrates a state in which the upper door 20 is fully opened.

In this embodiment, the upper door lock 47 and the front tray lock 49 respectively perform a moving operation and a turning operation in conjunction with a turning operation to the handle 45 so as to enhance operability and convenience, but the present invention is not limited thereto. The upper door lock 47 or the front tray lock 49 may be moved in conjunction with the operation of the handle 45.

(Locking Mechanism for Receiving Tray in Conjunction with Opening and Closing of Upper Door)

Figure 6:
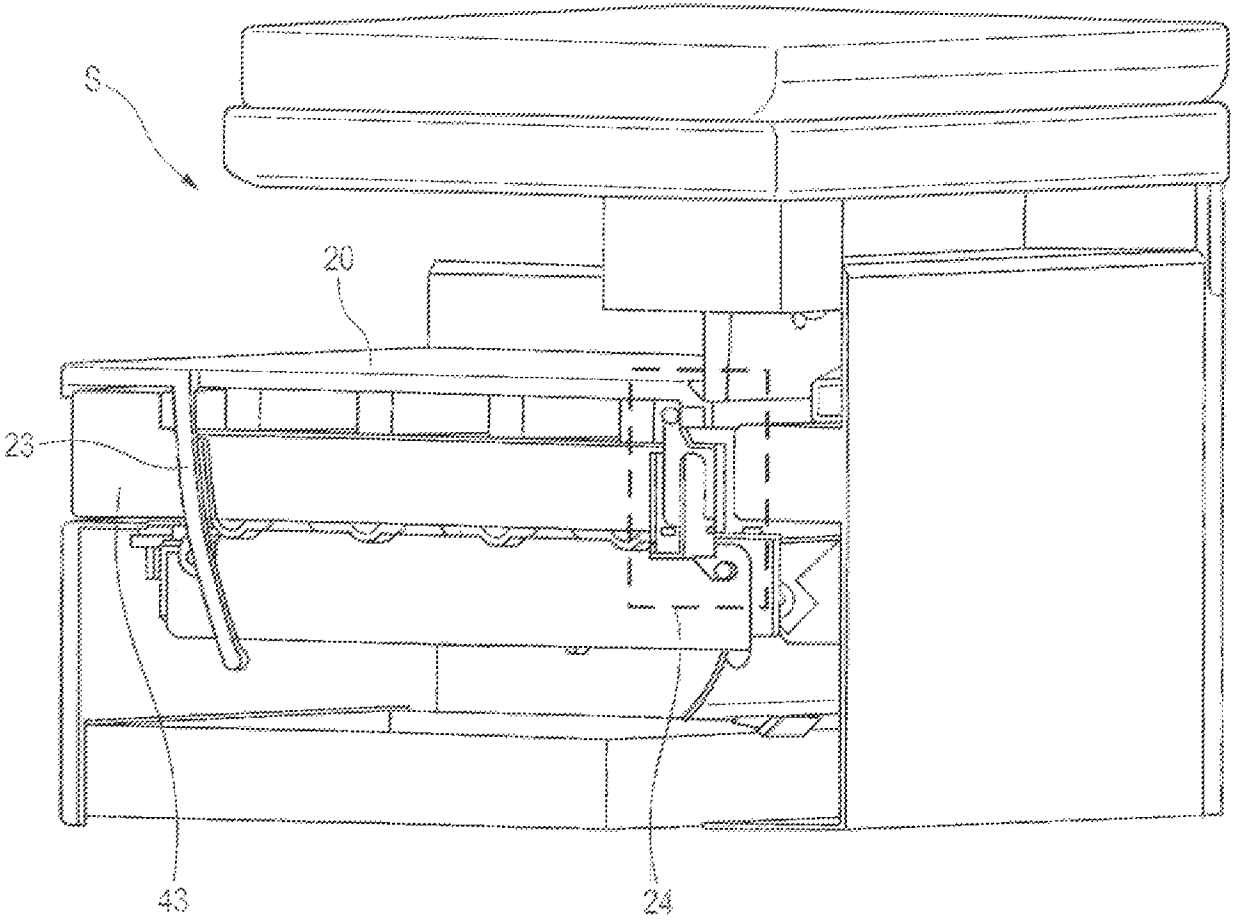
FIG. 6 is a schematic perspective view of the image forming apparatus according to the first embodiment as viewed from the rear.
Figure 7:
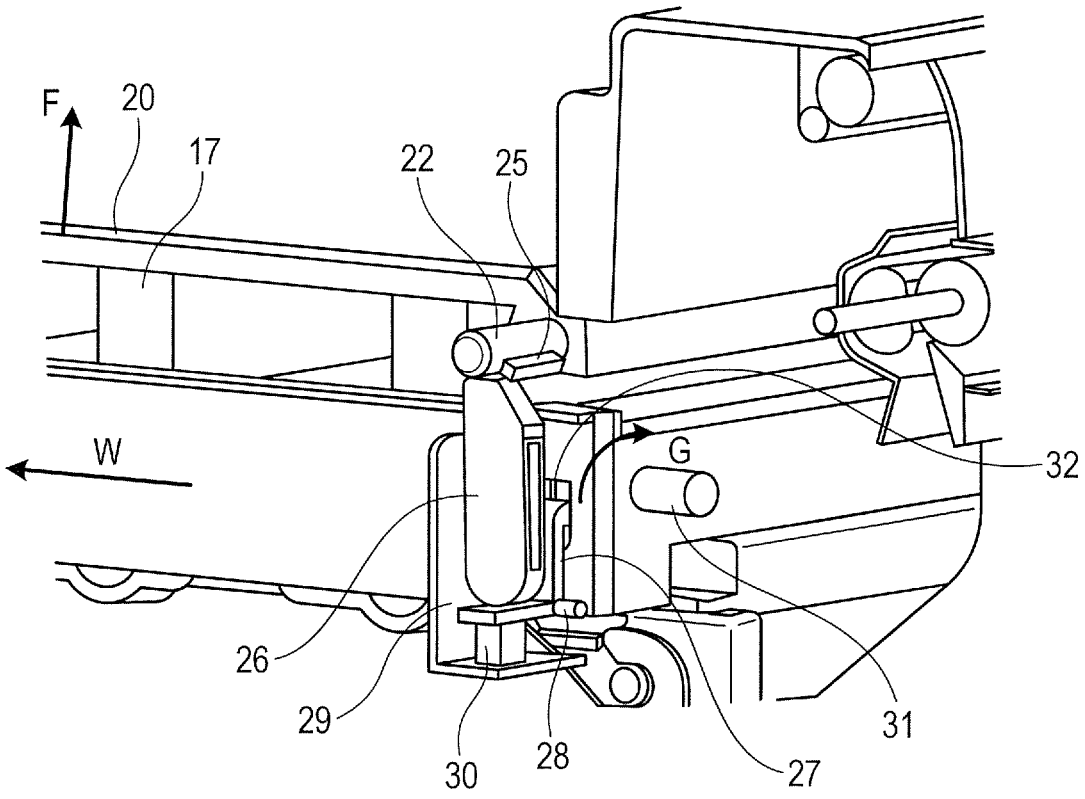
FIG. 7 is a schematic perspective view for describing a rear tray lock unit according to the first embodiment.
Figure 8:
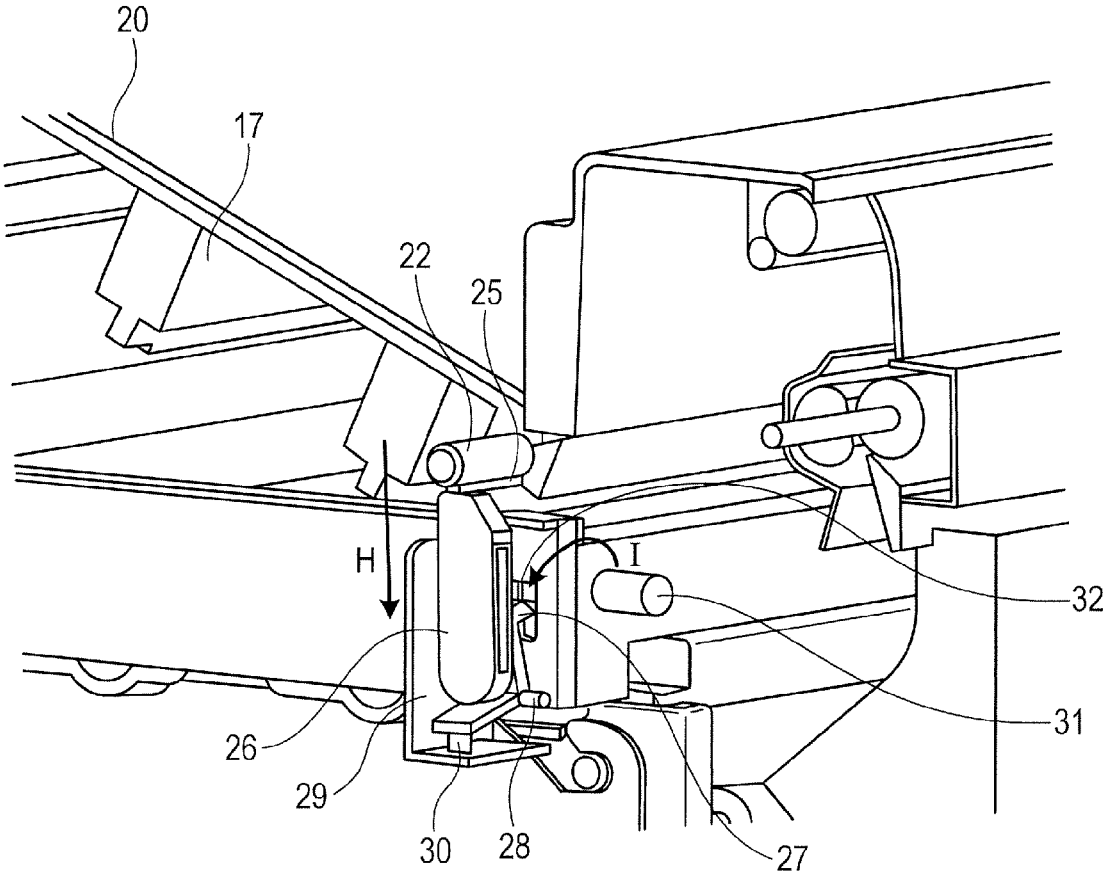
FIG. 8 is a schematic perspective view for describing the rear tray lock unit according to the first embodiment.

FIG. 6 is a schematic perspective view of the image forming apparatus S as viewed from the rear. FIGS. 7 and 8 are each a schematic perspective view for describing a rear tray lock unit 24. FIG. 7 illustrates a state in which the upper door 20 is locked by the handle 45, and FIG. 8 illustrates a state in which the upper door 20 is opened, and a rear tray lock 27 is released in conjunction with the upper door 20.

A locking mechanism (first locking mechanism) for locking the rear of the receiving tray 43 to the main body of the image forming apparatus S includes the rear tray lock unit 24, a rib 25 provided to the upper door 20, and a slit 32 provided through the receiving tray 43. When the rear of the receiving tray 43 is unlocked, the receiving tray 43 is unlocked in conjunction with the movement (turning operation and opening operation) of the upper door 20.

First, with reference to FIG. 7, a structure of the rear tray lock unit 24 is described.

The rear tray lock unit 24 includes an unlocking cam 26, the rear tray lock 27, a rear tray lock holder 29, and an urging spring 30. The rear tray lock 27 corresponds to a first locking member that is movable between a locking position at which the rear tray lock 27 is engaged with the receiving tray 43 and an unlocking position at which the rear tray lock 27 is disengaged from the receiving tray 43. The urging spring 30 corresponds to a first urging member for urging the rear tray lock 27 so that the rear tray lock 27 is located at the locking position.

The upper door 20 is mounted to the main body of the image forming apparatus S so as to be rotatable about the upper door rotation center 22. The rib 25 is formed at a root of the upper door rotation center 22. The rib 25 corresponds to a pressing member. The urging spring 30 and the rib 25 correspond to a first interlocking mechanism for converting the movement of the upper door 20 to movement of the rear tray lock 27.

The rib 25 is displaced along with an operation of opening the upper door 20 in the direction of the arrow F illustrated in FIG. 7. As described below, the rib 25 presses down the unlocking cam 26 against an urging force of the urging spring 30 so as to press the rear tray lock 27. The rib 25 is formed on the upper door rotation center 22 so as to start to press down the unlocking cam 26 at a timing described below.

It is a timing at which the LED units 17 on the upper door 20 each reach the predetermined retracted position at the time when the receiving tray 43 is drawn out from the main body of the image forming apparatus S (timing at which the LED units 17 are moved (retracted) to the predetermined retracted position, or timing after the LED units 17 are moved).

The predetermined retracted position is a position at which the LED unit 17 and other members on the receiving tray 43 (cartridge holding member) do not interfere with each other (are kept out of contact from each other) at the time when the receiving tray 43 is drawn out from the main body of the image forming apparatus S. The other members are the receiving tray 43, or members arranged on and held by the receiving tray 43 (such as the cartridges 41). In other words, the predetermined retracted position is a position at which the LED unit 17 is retracted above a movement trajectory of the receiving tray 43 and movement trajectories of the members arranged on and held by the receiving tray 43 (such as the cartridges 41) (at which the LED unit 17 does not overlap the movement trajectory, and the LED unit 17 is not present on the movement trajectory) at the time when the receiving tray 43 is drawn out from the main body of the image forming apparatus S.

The rear tray lock holder 29 is also fixed to the main body of the image forming apparatus S.

The rear tray lock 27 is arranged on the rear tray lock holder 29 so as to be rotatable about a rear tray lock rotation center 28, and is urged by the urging spring 30 in a direction of an arrow G illustrated in FIG. 7.

In the state illustrated in FIG. 7, the rear tray lock 27 is inserted into the slit 32 of the receiving tray 43, and the rear tray lock 27 is located at the locking position so as to lock the receiving tray 43 (restrict movement of the receiving tray 43). With this, the receiving tray 43 can be prevented from being moved (drawn out) in the direction of the arrow W illustrated in FIG. 7.

The unlocking cam 26 is mounted to the rear tray lock holder 29 so as to be slidable under a state in which the unlocking cam 26 is engaged with the rear tray lock 27. The unlocking cam 26 and the rear tray lock 27 are engaged with each other so that movement of the unlocking cam 26 and rotation of the rear tray lock 27 interlock with each other. The urging spring 30 urges the rear tray lock 27 and the unlocking cam 26 so that the rear tray lock 27 is located at the locking position at which the rear tray lock 27 is engaged with the receiving tray 43.

In this way, the structure of the locking mechanism for locking the receiving tray 43 in conjunction with the opening and closing operations of the upper door 20 is described.

Next, how the receiving tray 43 is unlocked in conjunction with the opening operation of the upper door 20 is described with reference to FIGS. 7 and 8.

In the state illustrated in FIG. 7, when the handle 45 is operated in the direction of the arrow C illustrated in FIG. 3, the upper door 20 locked by the locking mechanism is unlocked. As a result, the upper door starts to be opened in the direction of the arrow F illustrated in FIG. 7. The upper door 20 continues to be turned in the direction of the arrow F illustrated in FIG. 7. When the LED units 17 are each retracted to the predetermined retracted position, the rib 25 displaced along with the movement of the upper door 20 comes into contact with the unlocking cam 26.

After that, the upper door 20 still continues to be turned in the direction of the arrow F. With this, the rib 25 presses down the unlocking cam 26 against the urging force of the urging spring 30 in a direction of an arrow H illustrated in FIG. 8.

In conjunction with the movement of the unlocking cam 26, the rear tray lock 27 is turned in a direction of an arrow I illustrated in FIG. 8 so as to move to the unlocking position at which the rear tray lock 27 is disengaged from the receiving tray 43. With this, the rear tray lock 27 is perfectly pulled out of (disengaged from) the slit 32, and the receiving tray 43 locked by the rear tray lock 27 is unlocked.

In this way, the unlocking cam 26 is moved by the displacement of the rib 25 along with the movement of the upper door 20, and the receiving tray 43 is unlocked by the rotation of the rear tray lock 27 along with the movement of the unlocking cam 26.

At this time, when the handle 45 is pulled by the user as illustrated in FIG. 4, the front and rear of the receiving tray 43 are both unlocked. As a result, the receiving tray 43 is pushed out forward by an urging force of a tray push-out spring 31.

In this way, the user can forward draw out the receiving tray 43.

Figure 9:
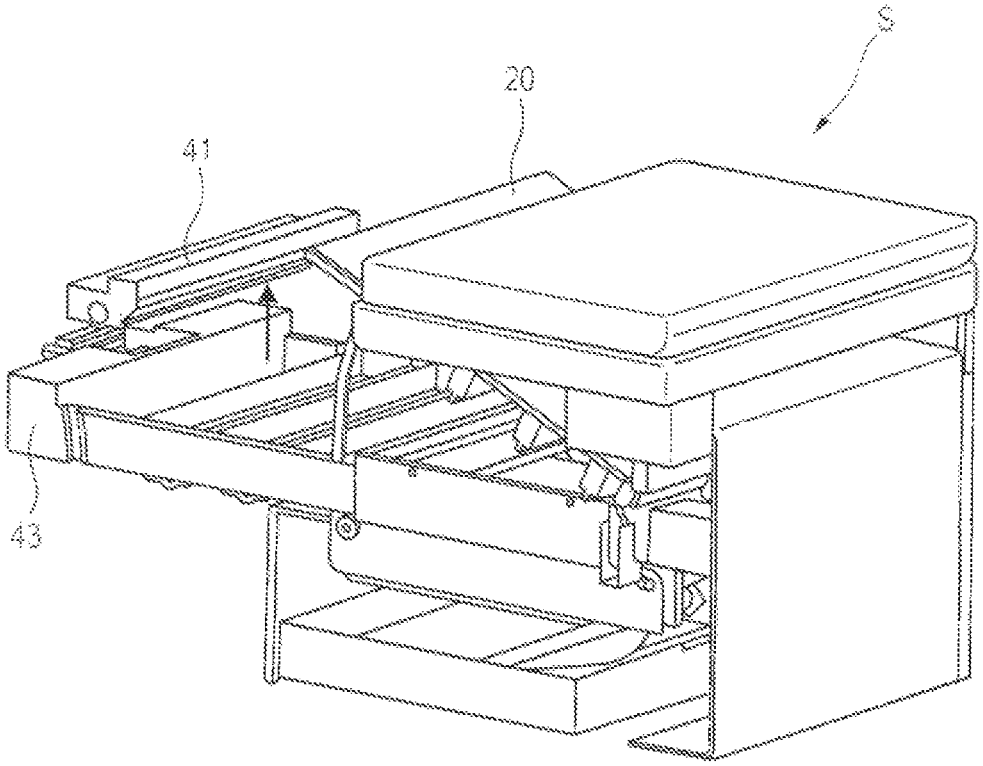
FIG. 9 illustrates a state in which the receiving tray is drawn out and a cartridge is taken out.

FIG. 9 illustrates a state in which the receiving tray 43 is drawn out to the front of the image forming apparatus S and the cartridge 41 is taken out upward.

Next, how the receiving tray 43 is locked in conjunction with the closing operation of the upper door 20 is described.

When the upper door 20 is closed under a state in which the receiving tray 43 is located at an image forming position, the rib 25 pressing the unlocking cam 26 is moved (turned) in a direction in which the rib 25 is moved away from the unlocking cam 26. The unlocking cam 26 is urged by the urging spring 30. Thus, when the rib 25 is moved away from the unlocking cam 26, the unlocking cam 26 is moved in a direction opposite to the direction of the arrow H illustrated in FIG. 8. Along with the movement of the unlocking cam 26, the rear tray lock 27 urged by the urging spring 30 is turned in the direction of the arrow G illustrated in FIG. 7. With this, the rear tray lock 27 is inserted into the slit 32 of the receiving tray 43, and the receiving tray 43 is locked.

In this embodiment, the locking mechanism for the receiving tray 43 includes the rear tray lock unit 24, the rib 25 provided to the upper door 20, and the slit 32 provided through the receiving tray 43, but the present invention is not limited thereto. That is, the locking mechanism for the receiving tray 43 only needs to keep the receiving tray 43 locked so that the receiving tray 43 cannot be drawn out from the main body of the image forming apparatus S until the LED units 17 are each retracted to the predetermined retracted position by moving the upper door 20. The locking mechanism for the receiving tray 43 unlocks the receiving tray 43 in conjunction with the movement of the upper door 20 so as to enhance operability and convenience, but the present invention is not limited thereto. For example, the unlocking operation for the receiving tray 43 may be performed not in conjunction with the movement of the upper door 20 but only when the LED units 17 on the upper door 20 are each located at the predetermined retracted position.

(Locking Mechanism for Locking Upper Door in Conjunction with Drawing-out Operation of Receiving Tray)

Figure 10:
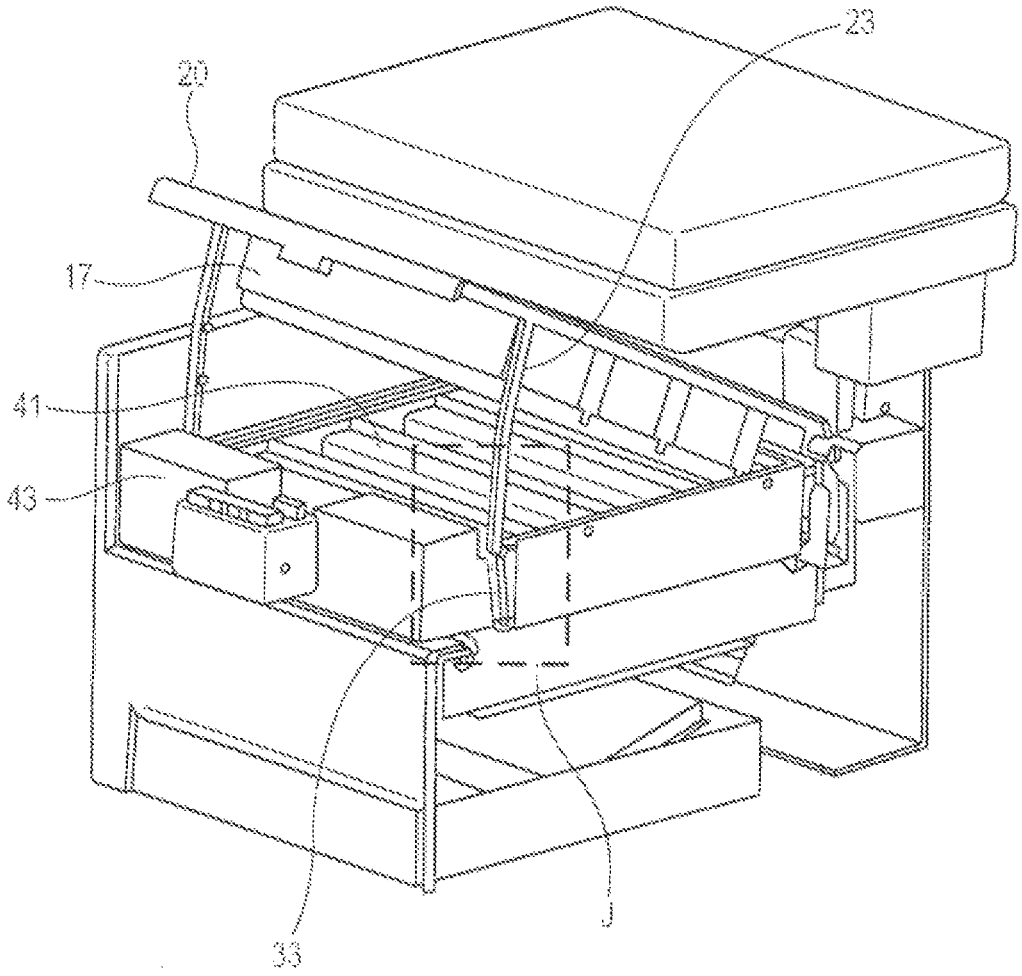
FIG. 10 is a schematic perspective view of the image forming apparatus according to the first embodiment in partial cross-section.
Figure 11:
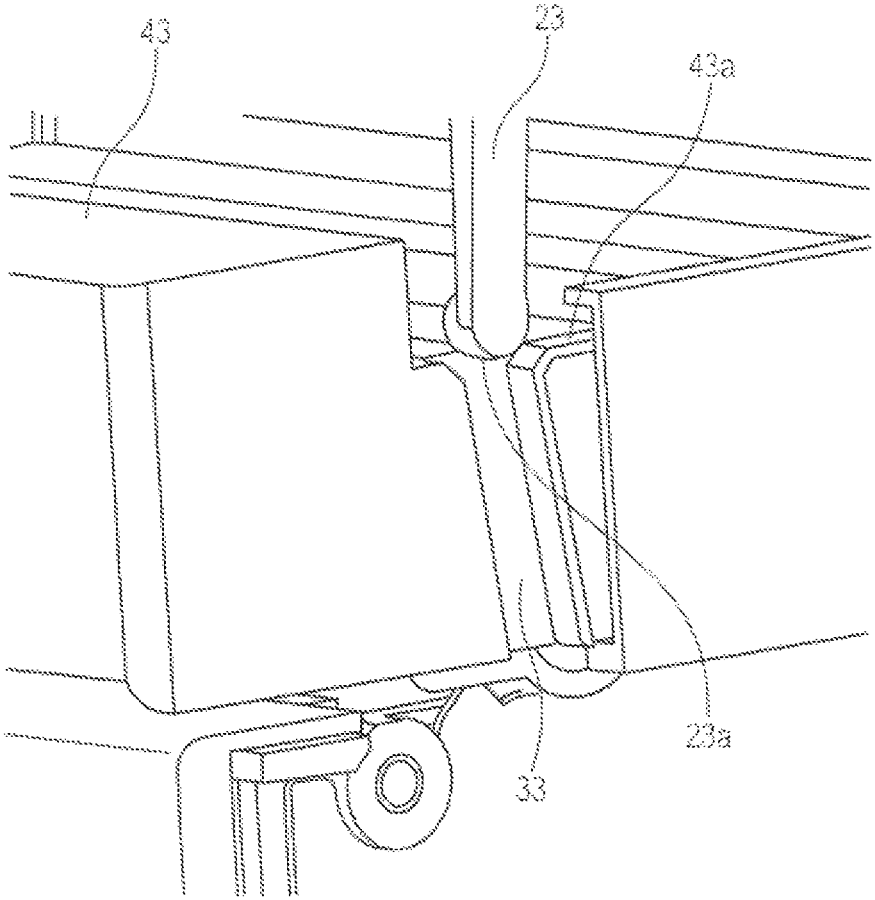
FIG. 11 is an enlarged view of a portion J illustrated in FIG. 10.

FIG. 10 is a schematic perspective view of the image forming apparatus S according to this embodiment in partial cross-section, for illustrating a state in which the upper door 20 is opened. FIG. 11 is an enlarged view of a portion J illustrated in FIG. 10.

A locking mechanism (second locking mechanism) for locking the upper door 20 under the state in which the upper door 20 is opened includes an upper door arm 23 that serves as an arm member extending downward from the upper door 20, and an upper surface 43*a* of the receiving tray 43. As illustrated in FIG. 11, a groove 33 that serves as a recessed portion is provided in a part of the front of the upper surface 43*a* of the receiving tray 43.

Under a state in which the receiving tray 43 is located at the image forming position (position at which the receiving tray 43 is locked by the front tray lock 49), the groove 33 serves as a guide that allows the upper door arm 23 to be slid along with the opening and closing operations of the upper door 20.

Figure 12:
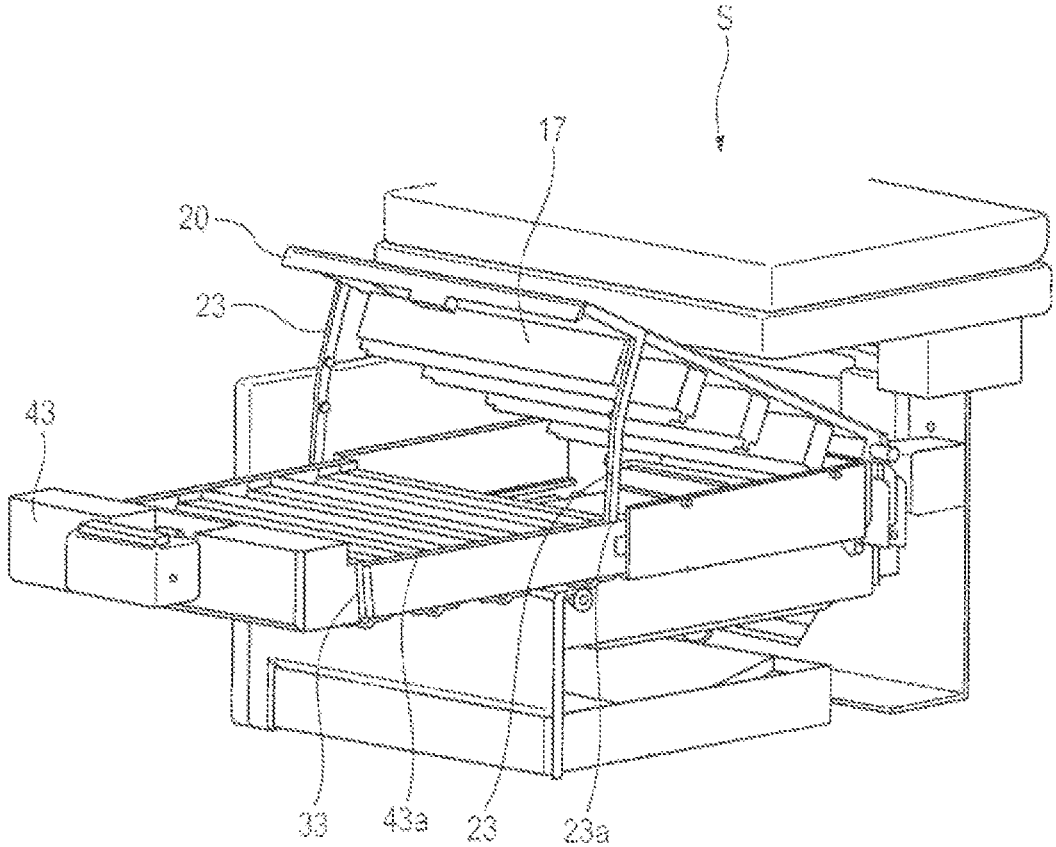
FIG. 12 is a schematic perspective view of the image forming apparatus according to the first embodiment in partial cross-section.

FIG. 12 is a schematic perspective view of the image forming apparatus S according to this embodiment in partial cross-section, for illustrating a state in which the receiving tray 43 is drawn out forward.

As illustrated in FIG. 12, under a state in which the receiving tray 43 is drawn out (under a state in which the receiving tray 43 is out of the image forming position), a lower end portion 23*a* of the upper door arm 23 interferes with (abuts or strikes against) the upper surface 43*a* of the receiving tray 43.

With this, under the state in which the receiving tray 43 is drawn out, even when an attempt to close the upper door 20 is made, the upper door arm 23 interferes with the upper surface 43*a* of the receiving tray 43 so as to lock the upper door 20. In this way, the upper door 20 cannot be closed. In other words, under the state in which the receiving tray 43 is drawn out, the upper door 20 can be prevented from being closed (upper door 20 can be suppressed from being moved downward). The upper surface 43*a* of the receiving tray 43 only needs to interfere with the lower end portion 23*a* of the upper door arm 23, and to be a surface of the receiving tray 43 that is oriented upward (surface located on an upper side of the receiving tray 43 and facing the upper door 20).

When the upper door 20 is closed, the receiving tray 43 is moved to the image forming position in a manner that the lower end portion 23*a* of the upper door arm 23 does not interfere with the upper surface 43*a* of the receiving tray 43 and the upper door arm 23 is slidable in the groove 33.

In conjunction with the operation of moving the receiving tray 43 to the image forming position (bringing the receiving tray 43 into a state in which the receiving tray 43 is not drawn out from the main body of the image forming apparatus), the upper door 20 is unlocked. With this, the upper door 20 can be closed.

In this embodiment, the locking mechanism for the upper door 20 includes the upper door arm 23 and the upper surface 43*a* of the receiving tray 43, but the present invention is not limited thereto. That is, the locking mechanism for the upper door 20 only needs to lock the upper door 20 so as not to return the LED units 17 from the predetermined retracted positions to the exposure positions when the receiving tray 43 is drawn out from the main body of the image forming apparatus S. The upper door 20 is unlocked in conjunction with the movement of the receiving tray 43 to the image forming position so as to enhance operability and convenience, but the present invention is not limited thereto. The upper door 20 may be unlocked not in conjunction with the movement of the receiving tray 43 to the image forming position.

(Procedure for Operation of Replacing Cartridges)

In this embodiment, an operating procedure that needs to be performed when replacing the cartridges 41 is formed with four interlocking locking mechanisms.

Through the operating procedure, the LED units 17 are prevented from being damaged during an operation in which the cartridges are replaced by a user, and reliable usability is achieved.

Now, a procedure in the operation in which the cartridges 41 are replaced by a user according to this embodiment is described.

In order to replace the cartridges 41, first, the user grips the handle 45 so as to unlock the upper door 20 and cancel the locking state of the front tray lock 49 as illustrated in FIG. 4. Then, the upper door 20 starts to be opened by the urging force of the urging spring 21 in the direction of the arrow F illustrated in FIG. 4.

In the process of opening the upper door 20, the LED units 17 supported by the upper door 20 are moved from the exposure positions to the predetermined retracted positions. Then, in conjunction with the opening operation of the upper door 20, the rear tray lock unit 24 shifts from the locking state in FIG. 7 to the unlocking state in FIG. 8. The LED units 17 are located at the retracted positions, and hence the LED units 17 and the receiving tray 43 or the cartridges 41 in the receiving tray 43 are kept out of contact from each other when the receiving tray is drawn out from the main body of the image forming apparatus S.

At this time, the handle 45 has been pulled, and hence the front tray lock 49 is released. In this state, the receiving tray 43 is pushed out forward by the urging force of the tray push-out spring 31.

In this state, the user can draw out the receiving tray 43 from the main body of the image forming apparatus S, and the drawn-out state is illustrated in FIG. 9.

Under the state illustrated in FIG. 9, the cartridges 41 are replaced.

At this time, even when the attempt to close the upper door 20 is made under the state illustrated in FIG. 9 or under the state in which the receiving tray 43 is halfway drawn out, the upper door arm 23 interferes with the upper surface 43*a* of the receiving tray 43, and hence the upper door 20 cannot be closed.

The locking mechanism for the upper door 20, which uses the upper door arm 23, can prevent the LED units 17 from being damaged by closing the upper door 20 under a state in which the receiving tray 43 is out of the image forming position during the operation of replacing the cartridges 41. In other words, when the upper door 20 is closed under the state in which the receiving tray 43 is drawn out from the main body of the image forming apparatus S, the LED units 17 are moved from the retracted positions to positions at which the LED units 17 interfere with the receiving tray 43 or the cartridges 41 held thereby. Thus, by returning the receiving tray 43 in this state into the main body of the image forming apparatus S, the receiving tray 43 or the cartridges 41 held thereby may collide against (interfere with) the LED units 17, and damage the LED units 17. As a countermeasure, the upper door 20 is not allowed to be closed under the state in which the receiving tray 43 is drawn out from the main body of the image forming apparatus S. With this, the LED units 17 are kept from being moved from the predetermined retracted positions. As a result, the LED units 17 can be prevented from being damaged.

After replacement of the cartridges 41, the user pushes the handle 45 or the front of the receiving tray 43. With this, the receiving tray 43 is pushed back to the image forming position.

When the receiving tray 43 is pushed back to the image forming position, as illustrated in FIG. 3, the front tray lock 49 is engaged with the front tray lock hole 44. In this way, the receiving tray 43 is fixed to the image forming position.

When the receiving tray 43 is received into the main body of the image forming apparatus S, the upper door locked by the upper door arm 23 is unlocked, and the upper door 20 can be pressed down.

When the upper door 20 is pressed down, in conjunction with the closing operation of the upper door 20, the upper door lock 47 is locked, and the rear tray lock 27 is inserted into the slit 32 of the receiving tray 43. In this way, the operation of replacing the cartridges 41 is completed.

As described above, according to this embodiment, under the state in which the cartridges 41 are located at the image forming positions in the main body of the image forming apparatus S and the upper door 20 is not fully opened, the cartridges 41 cannot be drawn out from the main body of the image forming apparatus S. Further, under the state in which the cartridges 41 are drawn out from the main body of the image forming apparatus S and located out of the image forming positions, the upper door 20 cannot be closed.

When the opening and closing operations of the upper door 20 and the insertion and removal of the cartridges 41 are restricted in this way, the LED units 17 supported by the upper door 20 can be prevented from being damaged at the time of replacement of the cartridges 41. With this, the cartridges 41 can be replaced with higher reliability, and hence usability (convenience) can be further enhanced.

In this embodiment, at the time of replacement of the cartridges 41, the upper door 20 is moved upward with respect to the receiving tray 43 so as to space the LED units 17 apart from the photosensitive drums 42, but the present invention is not limited thereto. The present invention is suitably applicable to any image forming apparatus in which the LED units 17 are spaced apart from the photosensitive drums 42 at the time of replacement of the cartridges 41.

Further, this embodiment has described the structure including the locking mechanism for locking the receiving tray 43 in conjunction with the opening and closing operations of the upper door 20, and the locking mechanism for locking the upper door 20 in conjunction with the drawing-out operation of the receiving tray 43, but the present invention is not limited thereto. That is, the image forming apparatus may include one of those two locking mechanisms.

Further, this embodiment has described the case where the LED unit 17 is used as the exposure device, but the present invention is not limited thereto. The present invention is suitably applicable to structures in which the exposure device is arranged near the photosensitive drum 42 and the exposure device may be damaged at the time of replacement of the cartridges.

Second Embodiment

Now, a second embodiment of the present invention is described.

Figure 13:
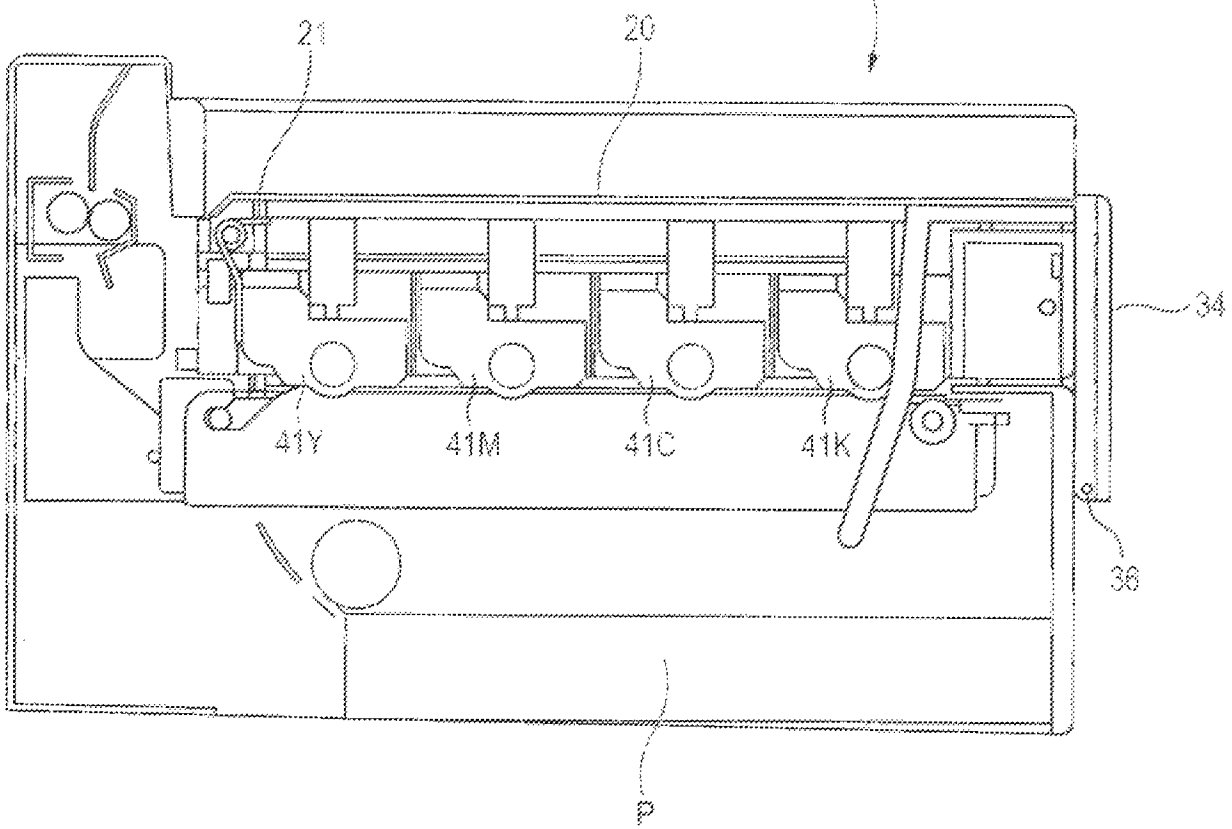
FIG. 13 is a sectional view of a schematic structure of an image forming apparatus according to a second embodiment of the present invention.

FIG. 13 is a sectional view of a schematic structure of an image forming apparatus S according to this embodiment.

In the first embodiment, the unlocking mechanism for the upper door 20 interlocks with the operation to the handle 45. In this embodiment, the unlocking mechanism for the upper door 20 interlocks with an opening operation of a front door 34. In this embodiment, the front door 34 corresponds to an operation member that is operated to forward draw out the receiving tray 43 from the main body of the image forming apparatus S.

First, a front door locking mechanism and an upper door locking mechanism interlocking with the front door, which are components different from those in the first embodiment, are described. Next, the procedure for the operation of replacing the cartridges 41 according to this embodiment is described. Note that, in this embodiment, components that are different from those in the first embodiment are described. The same components as those in the first embodiment are denoted by the same reference symbols, and description thereof is therefore omitted herein.

(Front Door Locking Mechanism)

Figure 14:
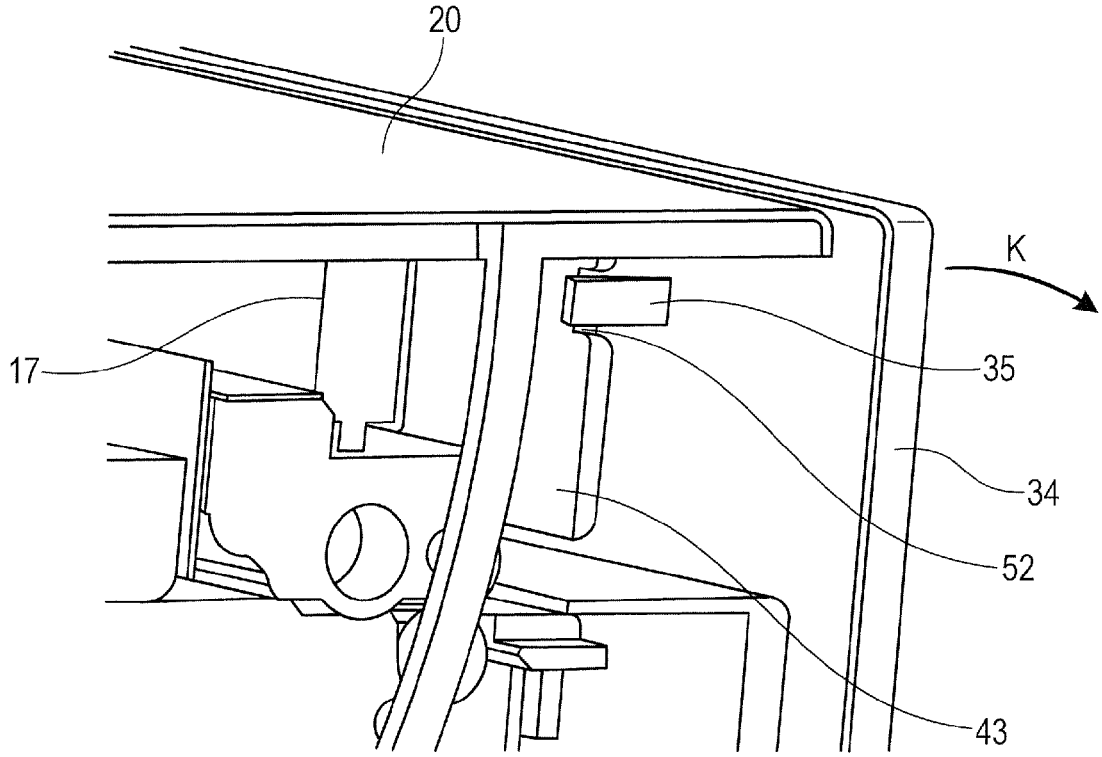
FIG. 14 is a schematic structural view of a vicinity of a front door locking mechanism according to the second embodiment under a state in which a front door is closed.

FIG. 14 is a perspective view of a schematic structure of a vicinity of a front door locking mechanism 35 under a state in which the front door 34 is closed.

The front door 34 is provided to the main body of the image forming apparatus S so as to be rotatable about a front door rotation center 36 illustrated in FIG. 13.

The front door 34 has the front door locking mechanism 35 formed thereon. When the front door locking mechanism 35 is engaged with a slit 52 formed in the receiving tray 43, the front door 34 is fixed (closed) with respect to the main body of the image forming apparatus S.

In this state, when the user pulls the front door in a direction of an arrow K illustrated in FIG. 14 (forward) with a force of a certain magnitude or greater, snap-fit of the front door locking mechanism 35 is released. As a result, the front door locking mechanism 35 is disengaged from the slit 52, and the front door 34 is opened. At this time, the front door 34 is turned in the direction of the arrow K about the front door rotation center 36.

(Locking Mechanism for Locking Upper Door in Conjunction with Front Door)

Figure 15:
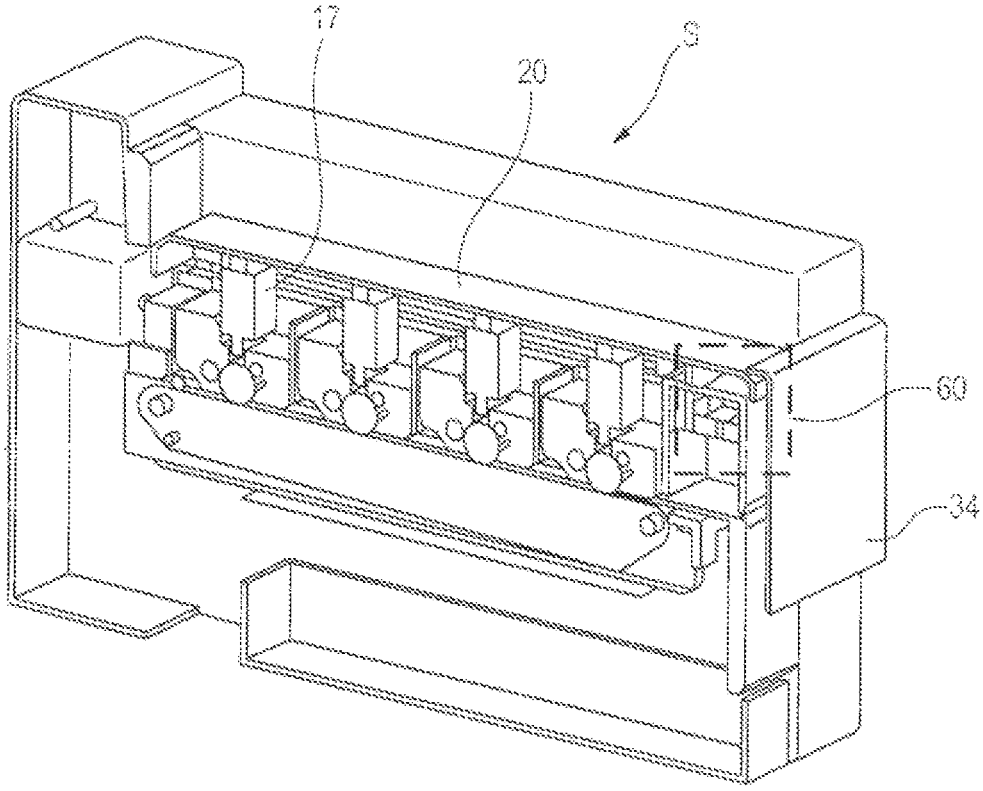
FIG. 15 is a sectional perspective view of the image forming apparatus according to the second embodiment.

FIG. 15 is a schematic sectional perspective view of the image forming apparatus S according to this embodiment in cross-section in a front-to-rear direction.

Figure 16:
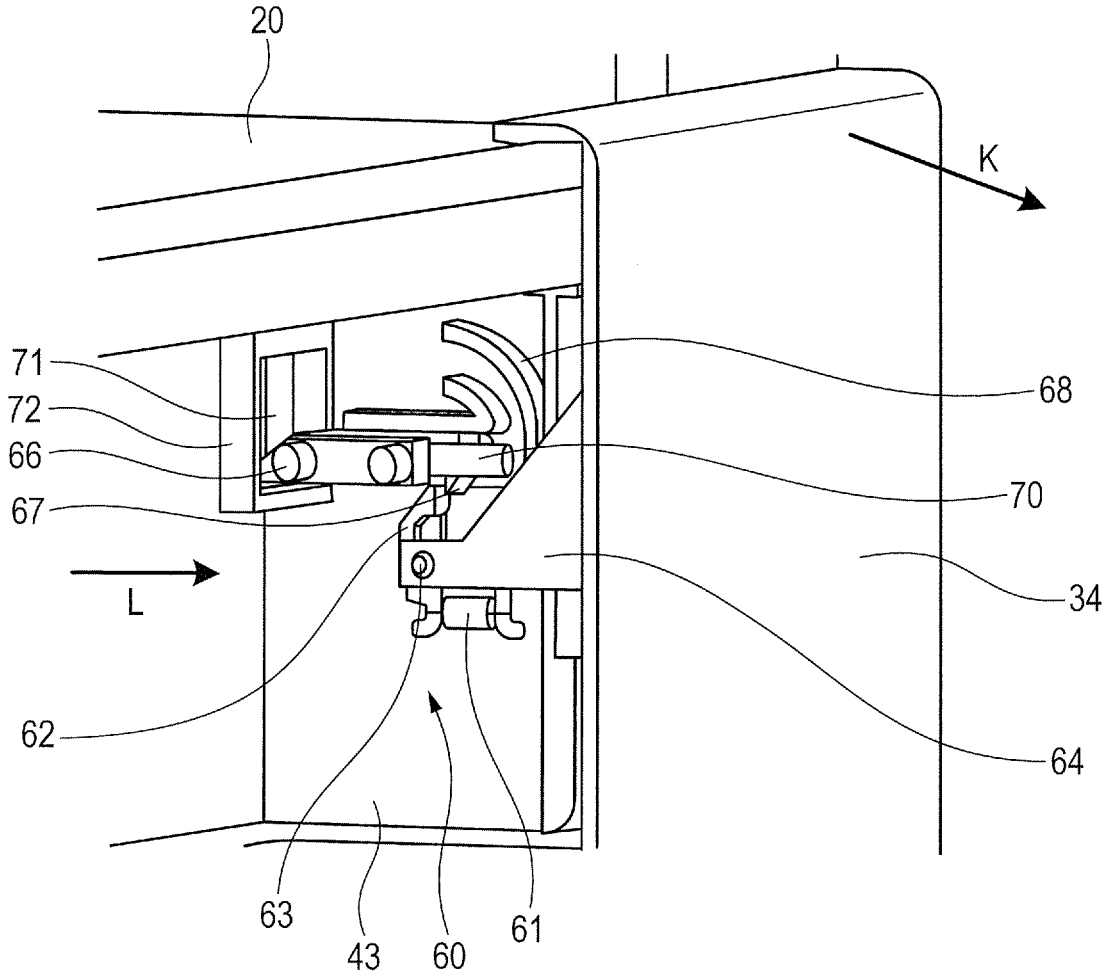
FIG. 16 is a schematic perspective view of an upper door locking mechanism according to the second embodiment.
Figure 17:
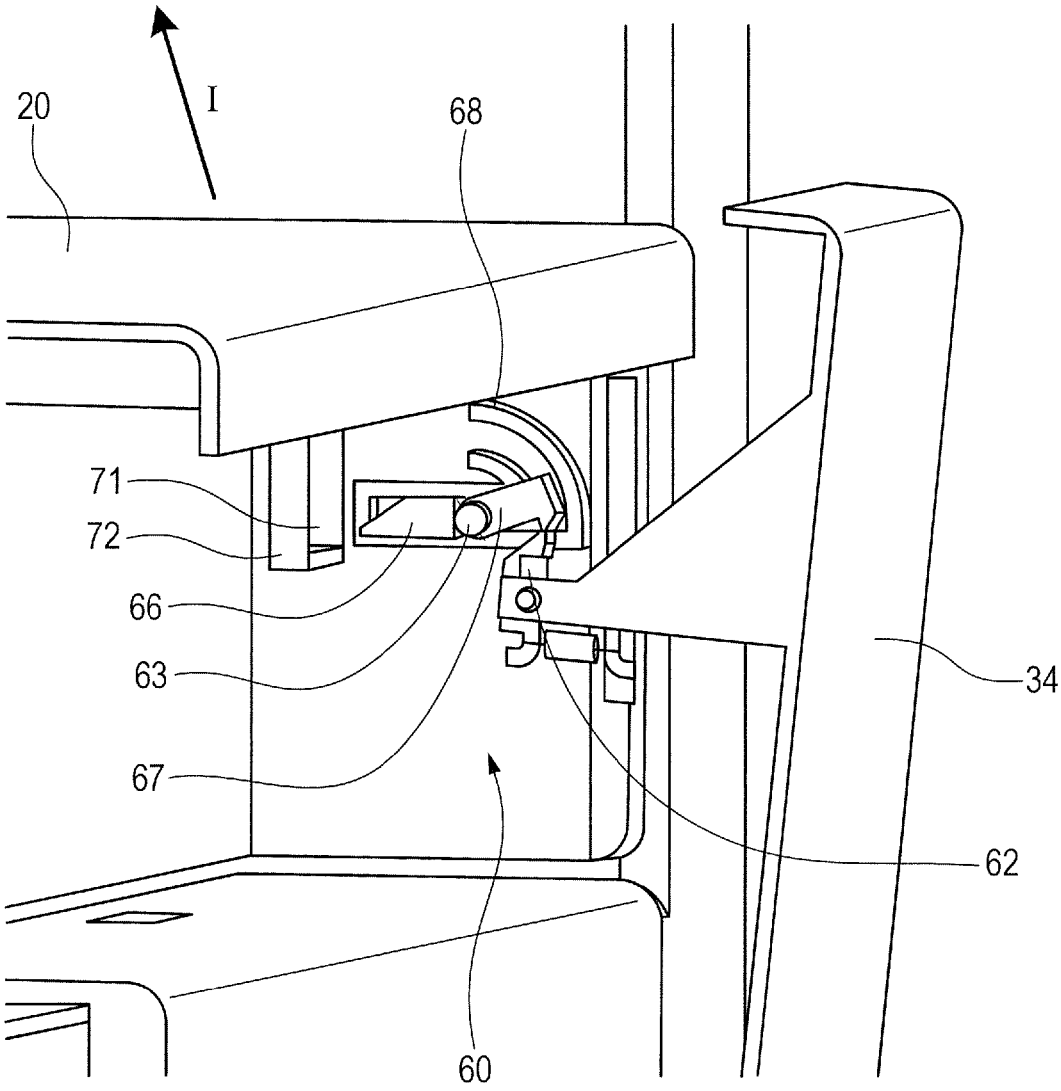
FIG. 17 is a schematic perspective view of the upper door locking mechanism according to the second embodiment.

As illustrated in FIG. 15, an upper door locking mechanism 60 that interlocks with the front door 34 is arranged in the front of the image forming apparatus S. FIGS. 16 and 17 are each a schematic perspective view of the upper door locking mechanism 60. FIG. 16 illustrates a locking state by the upper door locking mechanism 60, and FIG. 17 illustrates a state in which the locking state is unlocked by the upper door locking mechanism 60.

The upper door locking mechanism 60 includes a plurality of members arranged in each of the front door 34, the receiving tray 43, and the upper door 20. The front door 34 has a front door arm 64 formed thereon, and an unlocking claw 62 and a tension spring 61 are arranged at a distal end portion of the front door arm 64.

Figure 18:
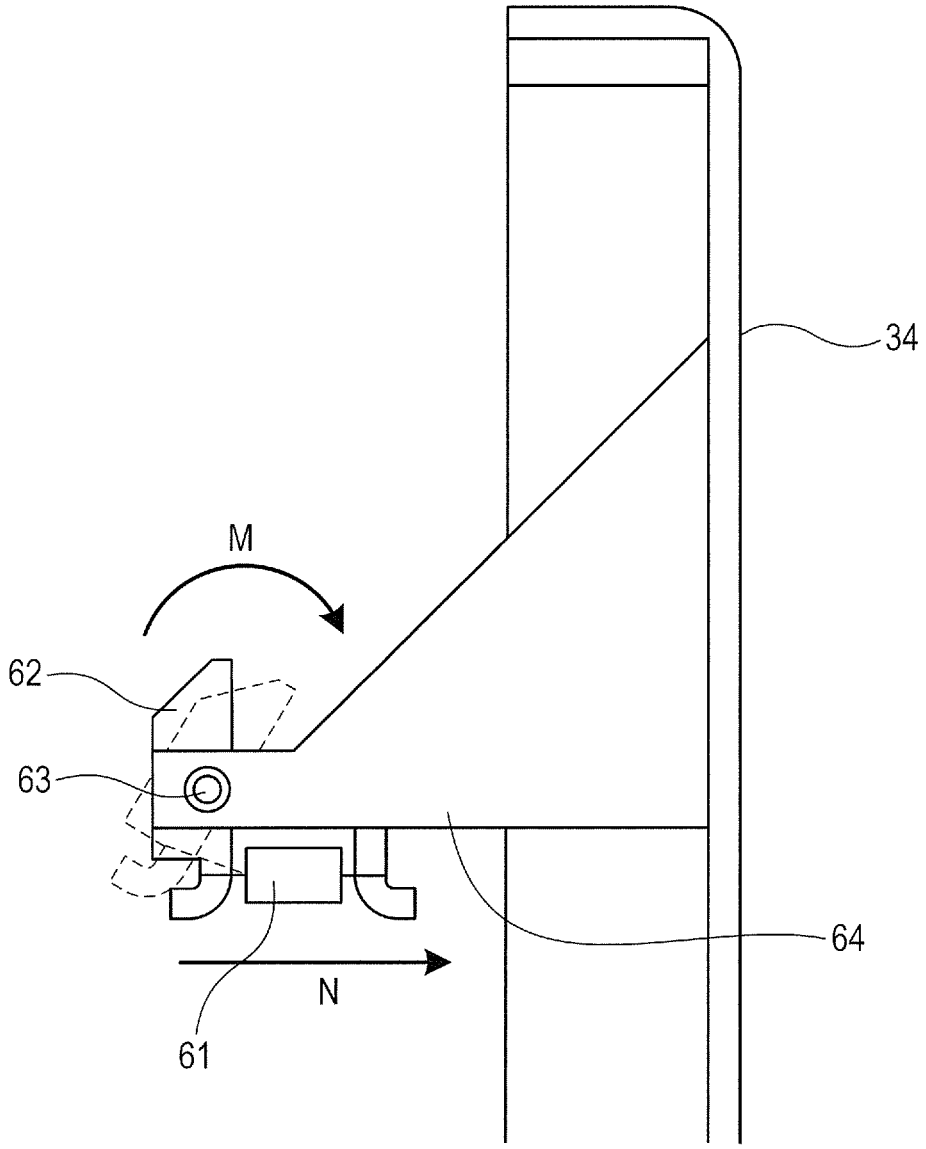
FIG. 18 is a schematic view of the front door and components of the upper door locking mechanism according to the second embodiment.

FIG. 18 is a schematic view of the front door 34 and the components of the upper door locking mechanism 60 arranged on the front door 34.

The unlocking claw 62 is supported by the front door arm 64 so as to be rotatable from a position indicated by a solid line in FIG. 18 in a direction of an arrow M about an unlocking claw rotation center 63.

When an external force is not applied to the unlocking claw 62, the unlocking claw 62 is urged by the tension spring 61 in a direction of an arrow N illustrated in FIG. 18. In this state, the unlocking claw 62 is located at a position (position indicated by the solid line in FIG. 18) at which the unlocking claw 62 interferes with (comes into contact with) a latching claw portion 67. With this structure, when the external force is applied in the direction of the arrow M illustrated in FIG. 18, the unlocking claw 62 is turned in the direction of the arrow M.

Figure 19:
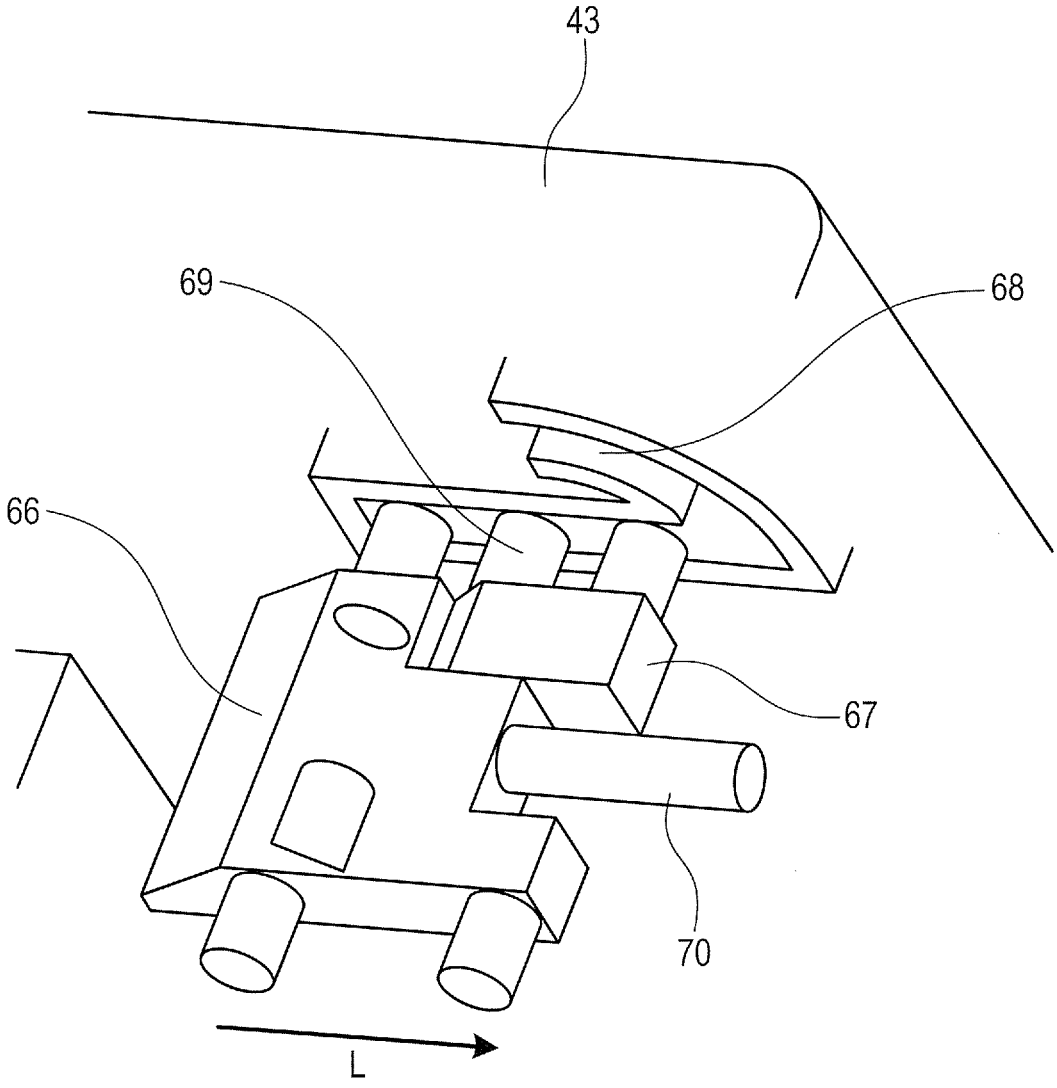
FIG. 19 illustrates components of the upper door locking mechanism and a receiving tray according to the second embodiment.
Figure 20:
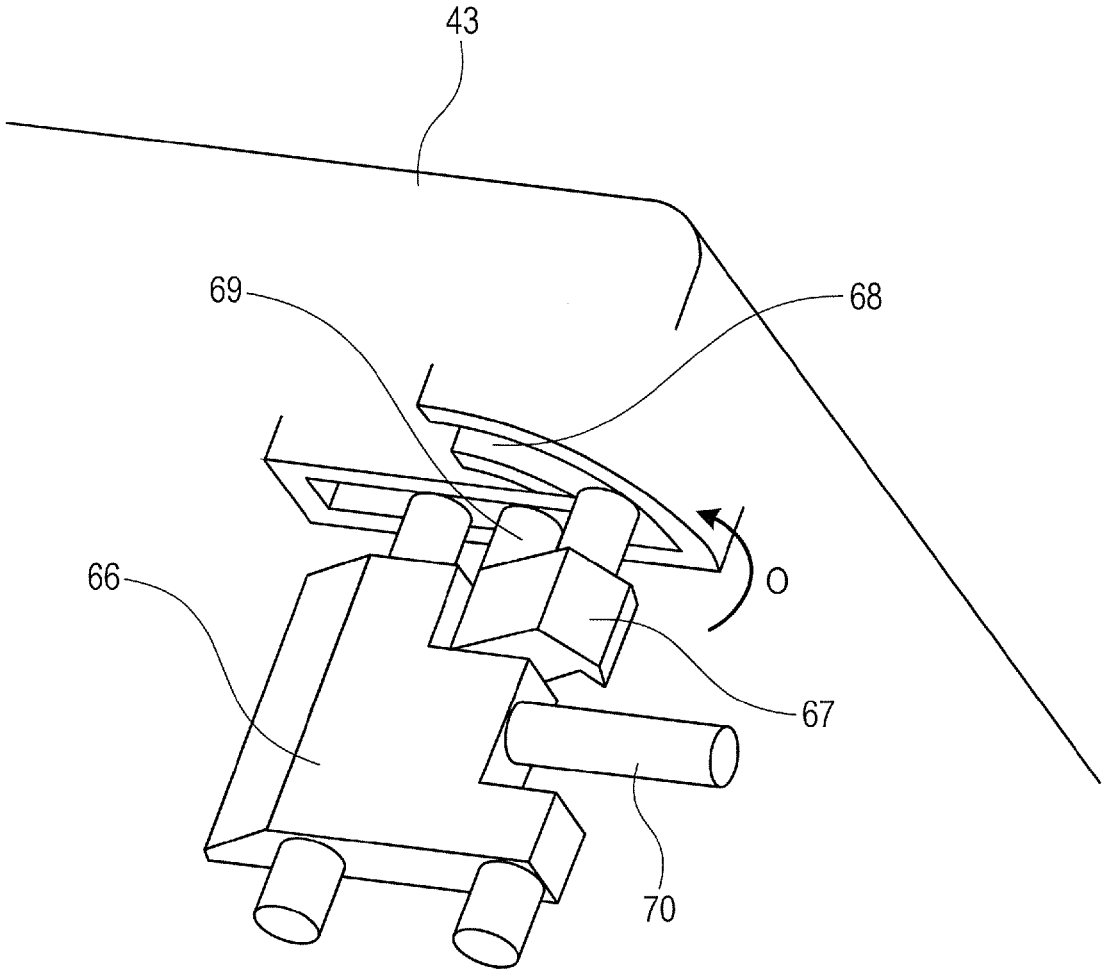
FIG. 20 is a schematic perspective view for describing a sliding operation of a latching claw portion according to the second embodiment.

FIG. 19 is a schematic perspective view of components of the upper door locking mechanism 60 and the receiving tray 43 in which the components are arranged. FIG. 20 is a schematic perspective view for describing a sliding operation of the latching claw portion 67.

In the receiving tray 43, an upper door latch 66 and the latching claw portion 67 are held in a slidable manner by a latch rail 68 formed on the receiving tray 43.

As illustrated in FIGS. 19 and 20, the upper door latch 66 and the latching claw portion 67 are engaged to be rotatable about a latching claw rotation center 69, and the upper door latch 66 and the latching claw portion 67 are slid integrally with each other along the latch rail 68.

With reference to FIGS. 16, 19, and 20, the sliding operation of the upper door latch 66 and the latching claw portion 67 is described.

First, when an external force is applied in a direction of an arrow L illustrated in FIGS. 16 and 19, the upper door latch 66 and the latching claw portion 67 are slid in the direction of the arrow L. Then, as illustrated in FIG. 20, only the latching claw portion 67 is turned about the latching claw rotation center 69 in a direction of an arrow O along a rail shape of the latch rail 68.

When application of the external force is stopped, a latch unit (assembly obtained through engagement of the upper door latch 66 and the latching claw portion 67) is returned to the position illustrated in FIGS. 16 and 19 (locking position) by an urging force of a latch spring 70.

As illustrated in FIG. 16, the upper door 20 is provided with a latch hole 71. Under a state in which the upper door 20 is closed, the upper door latch 66 enters the latch hole 71 as illustrated in FIG. 16. With this, the upper door 20 is locked.

The third locking mechanism includes the unlocking claw 62, the tension spring 61, the upper door latch 66, the latching claw portion 67, the latch rail 68, the latch spring 70, and the latch hole 71. The urging spring 21 and the third locking mechanism correspond to the second interlocking mechanism. In this way, the structure of the upper door locking mechanism 60 is described.

Next, how the upper door 20 is opened in conjunction with the opening operation of the front door 34 is described.

When the user pulls the front door 34 in the direction of the arrow K illustrated in FIG. 16 (forward), the front door 34 starts to be turned about the front door rotation center 36 in the direction of the arrow K.

Then, the unlocking claw 62 engaged with the front door arm 64 is also turned along with the turning operation of the front door 34, and the unlocking claw 62 comes into contact with the latching claw portion 67. In this state, when the front door 34 is further turned, the unlocking claw 62 moves the latching claw portion 67 together with the upper door latch 66 in the direction of the arrow L illustrated in FIG. 16.

When the upper door latch 66 is moved to be disengaged from the latch hole 71 as illustrated in FIG. 17, the upper door 20 is unlocked. Then, the upper door 20 starts to be opened by the urging force of the urging spring 21 illustrated in FIG. 13 in the direction of the arrow I illustrated in FIG. 17.

Subsequently, the latching claw portion 67 is moved upward along the shape of the latch rail 68 as illustrated in FIG. 17. With this, the unlocking claw 62 and the latching claw portion 67 are disengaged from each other.

Next, how the upper door locking mechanism 60 is moved in each of the cases where the upper door 20 is closed and the front door 34 is closed is described.

When the upper door 20 is closed, first, a distal end portion (lower end portion) of a latch hole member 72 arranged on the upper door 20 with the latch hole 71 formed therein abuts against a tapered portion provided at a distal end portion (end portion on a rearward side of the image forming apparatus S) of the upper door latch 66. When the upper door 20 continues to be closed, the distal end portion of the latch hole member 72 presses the tapered portion of the upper door latch 66. With this, the upper door latch 66 is moved in the direction of the arrow L in FIG. 16. When the upper door 20 is closed to a position at which the latch hole 71 faces the upper door latch 66, the upper door latch 66 enters the latch hole 71 by the urging force of the latch spring 70. With this, the upper door 20 is locked (refer to FIGS. 16 and 19).

When the front door 34 is closed, the tapered portion of the unlocking claw 62 abuts against the latching claw portion 67, and the unlocking claw 62 is turned in the direction of the arrow M illustrated in FIG. 18. As a result, the unlocking claw 62 and the latching claw portion 67 are engaged with each other. Simultaneously, the front door locking mechanism 35 of the front door 34 is engaged with the slit 52 of the receiving tray 43. In this way, the front door 34 is closed.

(Procedure for Operation of Replacing Cartridges)

Now, a procedure in the operation in which the cartridges 41 are replaced by a user according to this embodiment is described.

In order to replace the cartridges 41, first, the user opens the front door 34 so as to unlock the upper door 20 as illustrated in FIG. 17.

Then, the upper door 20 starts to be opened by the urging force of the urging spring 21 in the direction of the arrow I illustrated in FIG. 17.

In the process of opening the upper door 20, when the LED units 17 supported by the upper door 20 are moved to the retracted positions, in conjunction with the opening operation of the upper door 20, the rear tray lock unit 24 shifts from the locking state in FIG. 7 to the unlocking state in FIG. 8. As in the first embodiment, the retracted position is a position at which the LED unit 17 is retracted above sliding trajectories of the receiving tray 43 and the cartridges 41 in the receiving tray 43.

Figure 21:
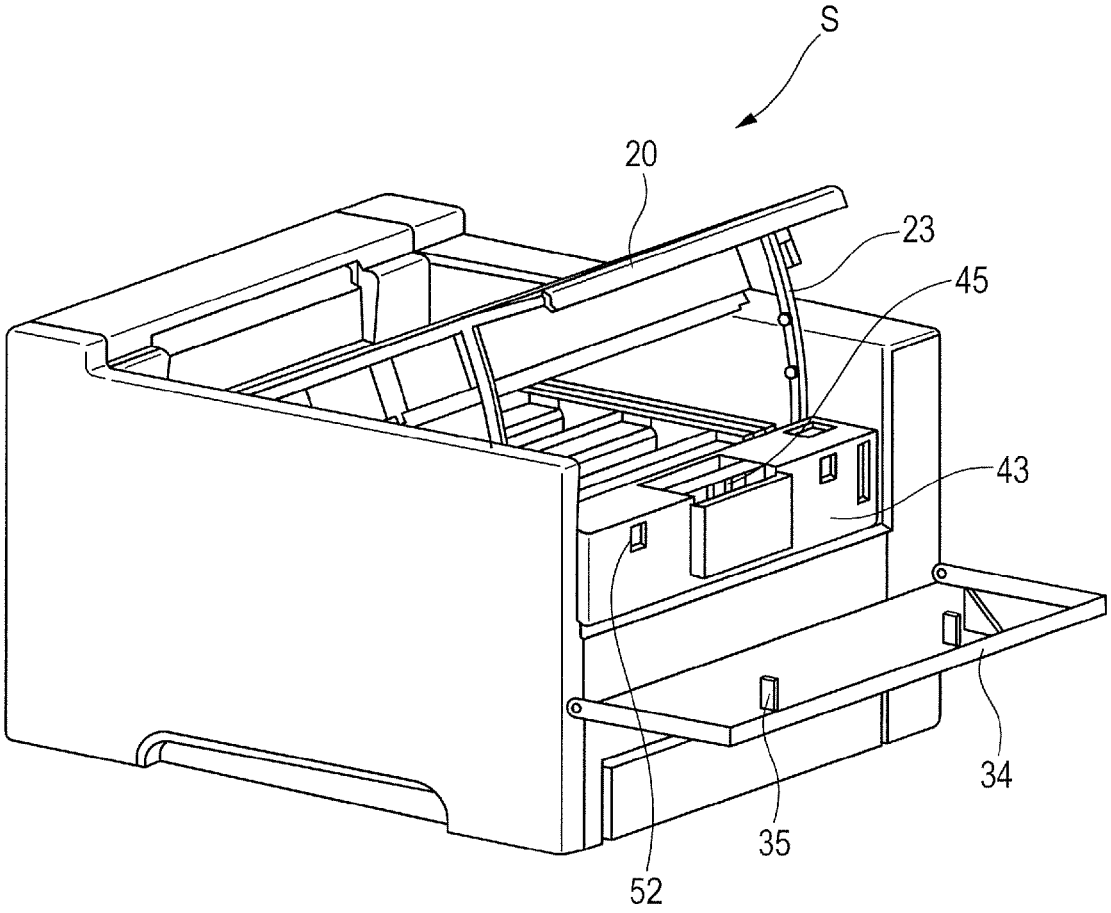
FIG. 21 is a schematic view of the image forming apparatus according to the second embodiment under a state in which an upper door is fully opened.
Figure 22:
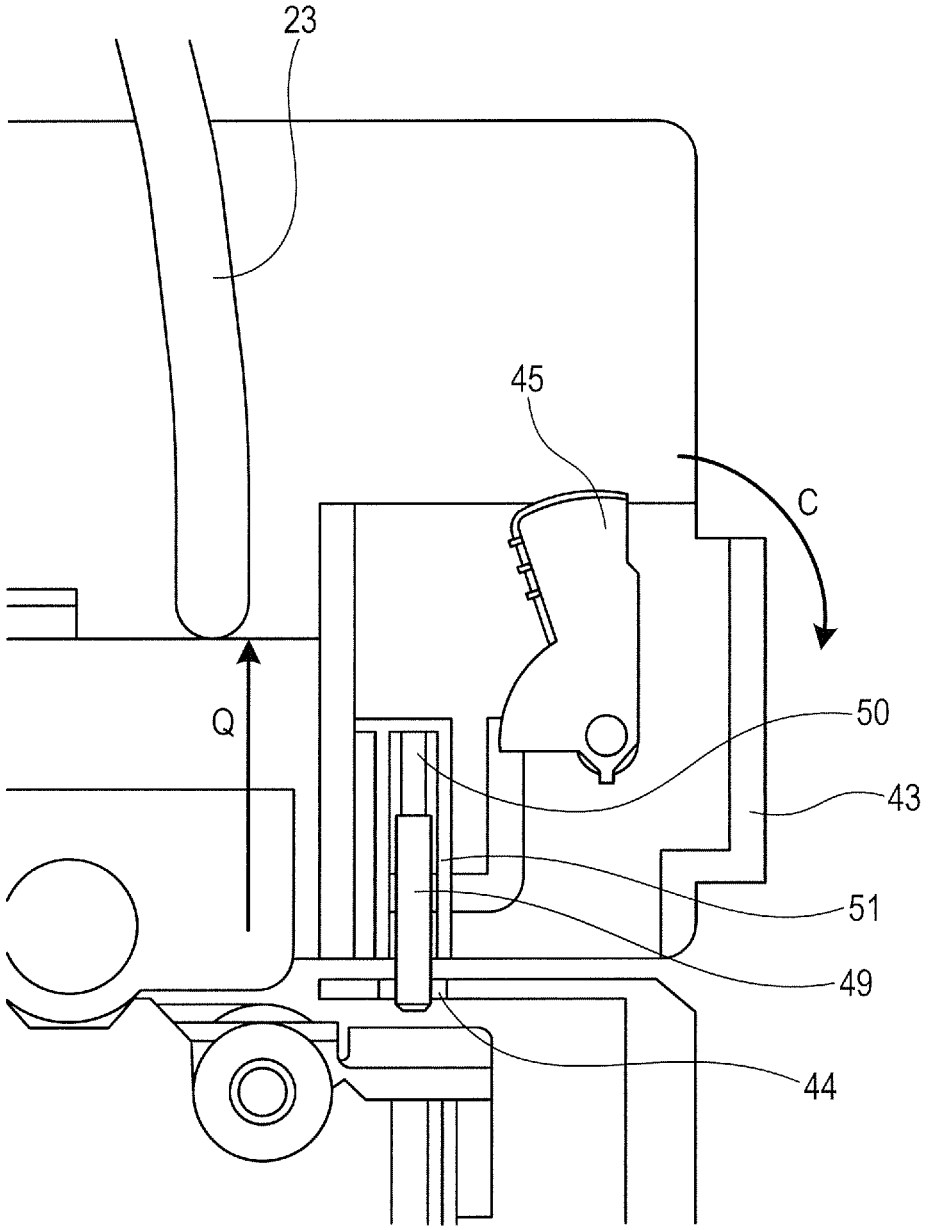
FIG. 22 is a schematic sectional view of an unlocking mechanism according to the second embodiment, which is operated with a handle.
Figure 23:
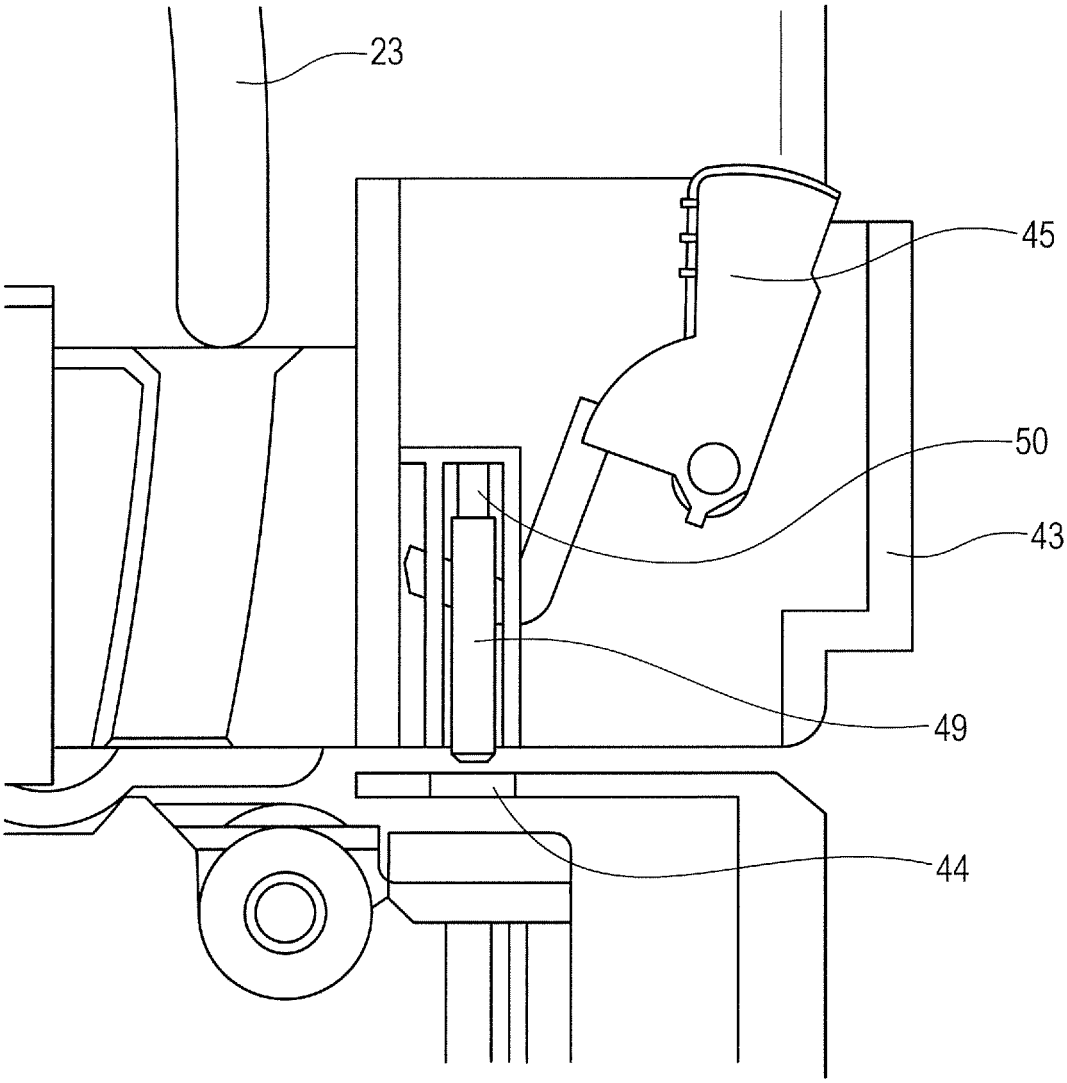
FIG. 23 is a schematic sectional view of the unlocking mechanism according to the second embodiment, which is operated with the handle.

FIG. 21 is a schematic perspective view of the image forming apparatus S under a state in which the upper door 20 is fully opened. FIGS. 22 and 23 are each a schematic sectional view of an unlocking mechanism that is operated with the handle 45.

As illustrated in FIG. 21, when the upper door 20 is fully opened, the user can access the handle 45. When the handle 45 is pulled in the direction of the arrow C illustrated in FIG. 22, the front tray lock 49 is moved in a direction of an arrow Q in FIG. 22 in conjunction with the handle 45. In this way, as illustrated in FIG. 23, the locking state of the front tray lock 49 and the front tray lock hole 44 is unlocked (as in the first embodiment).

As described above, when the front and rear of the receiving tray 43 are both unlocked, the receiving tray 43 is pushed out to the front by the urging force of the tray push-out spring 31.

In this way, under a state in which both the front tray lock 49 and the rear tray lock 27 are released, the user can eventually draw out the receiving tray 43.

Figure 24:
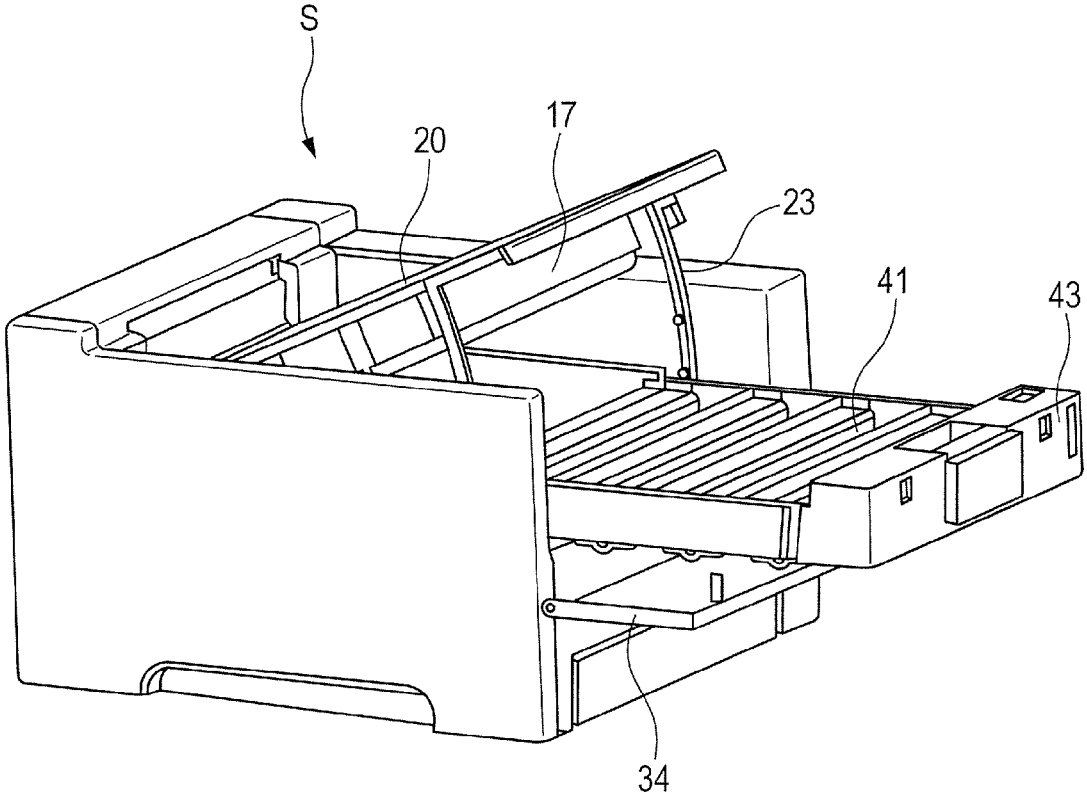
FIG. 24 is a schematic perspective view illustrating a state in which the receiving tray according to the second embodiment is drawn out.

FIG. 24 is a schematic perspective view illustrating a state in which the receiving tray 43 is drawn out.

Under the state illustrated in FIG. 24, the user pulls the cartridges 41 upward to replace the cartridges 41.

At this time, even when the attempt to close the upper door 20 is made under the state illustrated in FIG. 24 or under the state in which the receiving tray 43 is halfway drawn out, the upper door arm 23 interferes with the upper surface 43*a* of the receiving tray 43, and hence the upper door 20 cannot be closed as in the first embodiment. In other words, the LED units 17 are kept from being moved from the predetermined retracted positions. The locking mechanism for the upper door 20, which uses the upper door arm 23, can prevent the LED units 17 from being damaged by closing the upper door 20 under the state in which the receiving tray 43 is out of the image forming position during the operation of replacing the cartridges 41.

After replacement of the cartridges 41, the user pushes the handle 45 or the front of the receiving tray 43. With this, the receiving tray 43 is pushed back to the image forming position.

When the receiving tray 43 is pushed back to the image forming position, as illustrated in FIG. 22, the front tray lock 49 is engaged with the front tray lock hole 44. In this way, the receiving tray 43 is fixed to the image forming position.

When the receiving tray 43 is received into the main body of the image forming apparatus S, the upper door locked by the upper door arm 23 is unlocked, and the upper door 20 can be pressed down.

When the upper door 20 is pressed down, in conjunction with the closing operation of the upper door 20, the upper door 20 is locked by the upper door latch 66, and the rear tray lock 27 is inserted into the slit 32 of the receiving tray 43. Lastly, the front door 34 is closed, and the operation of replacing the cartridges 41 is completed. At this time, whether the upper door 20 is closed first or the front door 34 is closed first is not particularly limited.

As described above, according to this embodiment, also in the image forming apparatus including the front door 34 that is operated to draw out the receiving tray 43, the same advantages as those in the first embodiment can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-254294, filed on Nov. 20, 2012, which is hereby incorporated by reference herein in its entirety.

What is claimed is:

1. An image forming apparatus that exposes a photosensitive member so as to form a latent image, and transfers a toner image obtained through development of the latent image to form an image on a recording material, the image forming apparatus comprising:

an exposure device exposing the photosensitive member;

an exposure device support member supporting the exposure device;

a cartridge holding member holding a cartridge which includes the photosensitive member, the cartridge holding member being allowed to be drawn out from a main body of the apparatus by moving the exposure device support member; and a locking mechanism locking the cartridge holding member so as to prevent the cartridge holding member from being drawn out from the main body of the apparatus, the locking mechanism having:

a locking member that is movable between a locking position at which the locking member is engaged with the cartridge holding member and an unlocking position at which the locking member is disengaged from the cartridge holding member; and an interlocking mechanism moving the locking member by movement of the exposure device support member, mechanism having an urging in member urging the locking member so that the locking member is located at the locking position, and a pressing member that is displaced along with the movement of the exposure device support member and presses the locking member against an urging force of the urging member so as to move the locking member to the unlocking position.

2. An image forming apparatus according to claim 1, wherein the locking mechanism prevents the cartridge holding member from being drawn out from the main body until the exposure device is retracted to a retracted position at which the exposure device is prevented from interfering with one of the cartridge holding member and the cartridge held by the cartridge holding member when the cartridge holding member is drawn out from the main body of the apparatus.

3. An image forming apparatus according to claim 1, wherein the locking mechanism unlocks the cartridge holding member by retracting the exposure device to a retracted position.

4. An image forming apparatus according to claim 1, further comprising a second locking mechanism keeping the exposure device from being moved from a retracted position under a state in which the cartridge holding member is drawn out from the main body of the apparatus.

5. An image forming apparatus according to claim 4, wherein the second locking mechanism allows the exposure device to be moved from the retracted position by moving the cartridge holding member into the main body of the apparatus.

6. An image forming apparatus according to claim 4, wherein the exposure device support member is moved upward with respect to the cartridge holding member so as to retract the exposure device, wherein the second locking mechanism causes a lower end portion of an arm member, which extends downward from the exposure device support member, to strike against an upper surface of the cartridge holding member so that the exposure device support member is suppressed from being moved downward and the exposure device is kept from being moved from the retracted position.

7. An image forming apparatus according to claim 6, wherein a recessed portion is provided on a part of the upper surface of the cartridge holding member so as to prevent the lower end portion of the arm member from striking against the cartridge holding member under a state in which the cartridge holding member is in the main body of the apparatus.

8. An image forming apparatus according to claim 1, wherein the exposure device includes a plurality of light emitting elements that are arrayed in a direction of a rotation axis of the photosensitive member.

9. An image forming apparatus according to claim 1, wherein the cartridge has a plurality of cartridges, and wherein a direction in which the cartridge holding member is drawn out from the main body of the apparatus is the same as a direction in which the plurality of cartridges are arrayed.

10. An image forming apparatus that exposes a photosensitive member so as to form a latent image, and transfers a toner image obtained through development of the latent image to form an image on a recording material, the image forming apparatus comprising:

an exposure device exposing the photosensitive member;

a cartridge holding member holding a cartridge which includes the photosensitive member, the cartridge holding member being allowed to be drawn out from a main body of the apparatus by moving the exposure device to a retracted position, at which the exposure device is retracted from the cartridge;

a locking mechanism locking the cartridge holding member so as to prevent the cartridge holding member from being drawn out from the main body of the apparatus until the exposure device is retracted to the retracted position;

an operation member that is operated when drawing out the cartridge holding member; and an interlocking mechanism starting the exposure device to move to the retracted position in conjunction with operating the operation member.

11. An image forming apparatus according to claim 10, further comprising an exposure device support member supporting the exposure device, wherein the interlocking mechanism has an urging member urging the exposure device support member so as to move the exposure device to the retracted position, and a second locking mechanism locking the exposure device support member against an urging force of the urging member, and wherein, when the second locking mechanism is unlocked by operating the operation member, the exposure device support member is moved by the urging force of the urging member.

12. An image forming apparatus that exposes a photosensitive member so as to form a latent image, and transfers a toner image obtained through development of the latent image to form an image on a recording material, the image forming apparatus comprising:

an exposure device exposing the photosensitive member;

a cartridge holding member holding a cartridge including the photosensitive member, the cartridge holding member being allowed to be drawn out from a main body of the apparatus by moving the exposure device to a retracted position, at which the exposure device is retracted from the cartridge;

a locking mechanism keeping the exposure device from being moved from the retracted position under a state in which the cartridge holding member is drawn out from the main body of the apparatus;

an operation member that is operated when drawing out the cartridge holding member; and an interlocking mechanism starting the exposure device to move to the retracted position in conjunction with operating the operation member.

13. An image forming apparatus according to claim 12, wherein the retracted position is a position at which the exposure device is prevented from interfering with one of the cartridge holding member and the cartridge held by the cartridge holding member when the cartridge holding member is drawn out from the main body of the apparatus.

14. An image forming apparatus according to claim 12, wherein the locking mechanism allows the exposure device to be moved from the retracted position by moving the cartridge holding member into the main body of the apparatus.

15. An image forming apparatus according to claim 12, further comprising an exposure device support member supporting the exposure device, the exposure device support member being moved upward with respect to the cartridge holding member so as to retract the exposure device, wherein the locking mechanism causes a lower end portion of an arm member, which extends downward from the exposure device support member, to strike against an upper surface of the cartridge holding member so that the exposure device support member is suppressed from being moved downward and the exposure device is kept from being moved from the retracted position.

16. An image forming apparatus according to claim 15, wherein a recessed portion is provided on a part of the upper surface of the cartridge holding member so as to prevent the lower end portion of the arm member from striking against the cartridge holding member under a state in which the cartridge holding member is in the main body of the apparatus.

17. An image forming apparatus according to claim 12, wherein the exposure device includes a plurality of light emitting elements that are arrayed in a direction of a rotation axis of the photosensitive member.

18. An image forming apparatus according to claim 12, wherein the cartridge has a plurality of cartridges, and wherein a direction in which the cartridge holding member is drawn out from the main body of the apparatus is the same as a direction in which the plurality of cartridges are arrayed.

19. An image forming apparatus that exposes a photosensitive member so as to form a latent image, and transfers a toner image obtained through development of the latent image to form an image on a recording material, the image forming apparatus comprising:

an exposure device exposing the photosensitive member;

a cartridge holding member holding a cartridge which includes the photosensitive member, the cartridge holding member being allowed to be drawn out from a main body of the apparatus by moving the exposure device to a retracted position, at which the exposure device is retracted from the cartridge; and a locking mechanism locking the cartridge holding member so as to prevent the cartridge holding member from being drawn out from the main body of the apparatus until the exposure device is retracted to the retracted position; and a push-out member pushing the cartridge holding member, wherein the cartridge holding member is prevented by the locking mechanism from being pushed out until the locking mechanism is unlocked.

20. An image forming apparatus that exposes a photosensitive member so as to form a latent image, and transfers a toner image obtained through development of the latent image to form an image on a recording material, the image forming apparatus comprising:

an exposure device exposing the photosensitive member;

an exposure device support member supporting the exposure device;

a cartridge holding member holding a cartridge which includes the photosensitive member, the cartridge holding member being allowed to be drawn out from a main body of the apparatus by moving the exposure device support member;

a locking mechanism locking the cartridge holding member so as to prevent the cartridge holding member from being drawn out from the main body of the apparatus;

a door that is openably provided to the main body of the apparatus; and a support member locking mechanism locking the exposure device support member so as to prevent the exposure device support member from being moved, wherein the support member locking mechanism is unlocked by opening the door.

21. An image forming apparatus that exposes a photosensitive member so as to form a latent image, and transfers a toner image obtained through development of the latent image to form an image on a recording material, the image forming apparatus comprising:

an exposure device exposing the photosensitive member;

an exposure device support member supporting the exposure device;

a cartridge holding member holding a cartridge including the photosensitive member, the cartridge holding member being allowed to be drawn out from a main body of the apparatus by moving the exposure device support member; and a locking mechanism keeping the exposure device from being moved from a retracted position under a state in which the cartridge holding member is drawn out from the main body of the apparatus;

a door that is openably provided to the main body of the apparatus; and a support member locking mechanism locking the exposure device support member so as to prevent the exposure device support member from being moved, wherein the support member locking mechanism is unlocked by opening the door.

* * * * *